US007131161B2

(12) United States Patent
Lee

(10) Patent No.: US 7,131,161 B2
(45) Date of Patent: Nov. 7, 2006

(54) FIBER REINFORCED POLYMER COMPOSITE BRIDGE DECK OF TUBULAR PROFILE HAVING VERTICAL SNAP-FIT CONNECTION

(76) Inventor: Sung Woo Lee, 9/1505 Kyungnam Apt., 649 Gaepo-1-dong, Kangnam-gu, Seoul 135-241 (KR)

( * ) Notice: Subject to any disclaimer, the term of this patent is extended or adjusted under 35 U.S.C. 154(b) by 0 days.

(21) Appl. No.: 11/086,951

(22) Filed: Mar. 22, 2005

(65) Prior Publication Data

US 2006/0048311 A1 Mar. 9, 2006

(51) Int. Cl.
*E01D 19/12* (2006.01)
*E01C 5/20* (2006.01)
*E01C 19/08* (2006.01)

(52) U.S. Cl. ..... 14/73; 14/73.1; 14/77.1; 404/34; 404/36

(58) Field of Classification Search ..... 404/29, 404/34–40, 17–20, 44–46, 47, 50, 55, 57; 405/17–20; 14/73, 73.1, 77.1
See application file for complete search history.

(56) References Cited

U.S. PATENT DOCUMENTS 3,172,508 A * 3/1965 Doering et al. ..... 52/579
3,236,017 A * 2/1966 Doering ..... 52/579
3,301,147 A * 1/1967 Clayton et al. ..... 404/35
3,319,543 A * 5/1967 Braeuninger et al. ..... 404/35
3,450,010 A * 6/1969 Myer ..... 404/35
3,460,304 A * 8/1969 Glaza et al. ..... 52/588.1
3,602,110 A * 8/1971 Wiggins ..... 404/40
4,266,381 A * 5/1981 Deller ..... 52/177
5,050,361 A * 9/1991 Hallsten ..... 52/581
5,617,677 A * 4/1997 Hallsten ..... 52/3
5,941,027 A * 8/1999 Hallsten ..... 52/64
5,993,107 A * 11/1999 Bauer ..... 404/43
6,449,790 B1 * 9/2002 Szekely ..... 14/69.5
6,467,118 B1 10/2002 Dumlao et al. ..... 14/73
6,591,567 B1 7/2003 Hota et al. ..... 52/578
6,789,367 B1 * 9/2004 Dando ..... 52/657

* cited by examiner

*Primary Examiner*—Raymond Addie
(74) *Attorney, Agent, or Firm*—Cantor Colburn LLP

(57) ABSTRACT

A fiber reinforced polymer composite deck module is used to form a deck constructed by assembling the deck modules. The deck module comprising an upper plate having an upper extension at its one side, a lower plate having a lower extension at its one side opposite to the side of the upper plate, and an interlink plate therebetween, forming therein a plurality of divisional portions of polygonal tubular cross-sectional shape, wherein at one side, including a first interlocking piece protruded downward at the end of the extension of the upper plate and a second interlocking piece protruded downward at a lower outer surface of the interlink plate, and at the other side, including a third interlocking piece protruded upward at an upper outer surface of the interlink plate and a fourth interlocking piece protruded upward at the end of the extension of the lower plate, wherein upon assembling the deck modules with each other, the first and second interlocking pieces of one module are detachably and mechanically snap-fit coupled to the third and fourth interlocking pieces, respectively, of the other module, and wherein the interlocking pieces coupled to each other have protrusions with a shape corresponding to each other for mutual mechanical engagement so that neighboring deck modules are detachably and mechanically snap-fit coupled in a vertical direction to each other to form a deck.

10 Claims, 24 Drawing Sheets

FIBER REINFORCED POLYMER COMPOSITE BRIDGE DECK OF TUBULAR PROFILE HAVING VERTICAL SNAP-FIT CONNECTION

BACKGROUND OF THE INVENTION

1. Field of the Invention

The present invention relates to bridge deck modules fabricated using fiber reinforced polymer composite materials having a polygonal tubular cross-section and having a snap-fit connections, and it also relates to fiber reinforced polymer composite bridge decks constructed using such bridge deck modules.

2. Description of the Prior Art

As an alternative to reinforced concrete bridge deck, fiber reinforced composite bridge deck with lightweight, high strength and high durability has been proposed. U.S. Pat. No. 6,467,118 discloses a load bearing deck structure being made of at least one sandwich panel which comprises a plurality of hollow, elongated core members having side walls, the core members being provided with an upper facesheet and a lower facesheet.

Further, U.S. Pat. No. 6,591,567 discloses a lightweight fiber reinforced polymer composite decks having a fiber reinforced polymer composite module that interlocks with other similarly designed module. FIGS. 1A and 1B in this specification correspond to FIGS. 1 and 4 disclosed in U.S. Pat. No. 6,591,567, respectively. The module 100 disclosed in U.S. Pat. No. 6,591,567 is designed as having a male end 132 and a female end 134 such that adjacent module interlock together by inserting the male end 132 into the female end 134 of the adjacent module. Therefore, the bridge deck 400 is created by interlocking together two or more modules 100 with adhesives.

Meanwhile, in the case of bridge deck 400, a shear connection between the bridge deck and a girder should be provided to have composite action with girder. Generally, in order to connect the deck to the girder integrally, shear connectors such as shear studs are provided on the top of the girder.

In FIGS. 1A and 1B, in order to fabricate the deck 400 with the deck modules 100, a deck module 100, in which adhesives are applied in the tongue and groove parts, should be pushed into a horizontal direction to assemble. Further, in FIG. 1B, in order to connect the deck 400 side by side on the top of the girder 402, the deck 400 should also be glued at connecting tongue and groove part, and it is pushed horizontally so that it is assembled with the neighboring deck 400. In this way, therefore, shear connectors, positioned in vertical direction on the top of the girder, could not be provided until the decks 400 are assembled completely. This is because if shear connectors has already been provided on the top of the girder 402 prior to the assemblage of the deck, the deck 400 could not be pushed horizontally to the adjacent deck. However, if the shear connectors are provided after the assemblage of the deck, the following inconveniences can be accompanied.

First, it is inconvenient that the shear connectors should be installed from the top of the deck through the pre-drilled hole in the deck at the construction site after the deck 400 has been assembled. When the girder 402 is made of steel, it is preferable to install the shear connectors on the upper flange of the girder 402 through welding before the girder 402 is in place. In such structure of the prior art however, the shear connectors could not be installed beforehand but had to be directly installed through confined small working hole at a place only after girder 402 is in place. This causes bad workability in the site and takes much time, effort and costs in installing decks.

Second, if composite deck is used for the purpose of replacing deteriorated concrete deck of the bridge, to install composite deck of such tongue and groove type horizontally on the top of the existing girder, the shear studs welded at the top of the girder should be removed after dismantling the concrete deck. Then, after installation of composite deck, new shear studs should be installed again through the hole of the deck to connect to existing girder of the bridge. In this case, it takes double costs in removal and reinstallation of the shear connectors.

Third, for such composite deck of tongue and groove type, adhesives should be used to bond modules and decks to each other. However, in such case, when disjointing and removing of the deck is necessary for reuse or repair purpose, it is nearly impossible to cleanly break up the deck.

Fourth, since welding of shear connectors to girder for such composite deck of tongue and groove type is done from the top of the deck through the drilled small hole generally with stud gun, construction workability is bad, and quality control of welding is difficult.

Fifth, if the girder is made of concrete, work for deck connection to girder at site is far more difficult. In this case, after placement of the deck on the top of the girder, shear bars of channel type are installed through the small working hole in the deck. Prior to installation of shear bars, drilling of bar holes in the concrete girder through the small hole of the deck is inevitable. Inserting shear bars into this hole at the girder and adhesive grouting are followed. Construction workability of this process is very bad and moreover, the reinforcing bar or prestressing tendon in the concrete girder might be in danger of cut during drilling holes and it may jeopardize the structural safety of the bridge. Further, quality control of this type work is very difficult.

In the prior art in which the deck module 100 should be pushed in a horizontal direction on the top of the girder 402 in order to assemble the deck 400, many problems as described above can be arisen.

Meanwhile, in the deck module of U.S. Pat. No. 6,591,567 as shown in FIGS. 1A and 1B, adhesive bonding between the male end 132 and the female end 134 is necessary for integral action of the assembled deck. However, the durability of the adhesive is not yet verified completely, and it cannot be guaranteed through the long life time of bridge. Also, the adhesive such as epoxy requires considerable curing time, and it takes relatively long construction time for deck assemblage compared to connection methods other than bonding. Particularly, if the deck modules are connected with each other by use of adhesives, it can hardly be disassembled in order for repair or reuse in the later time.

Since composite bridge deck module mentioned above is only for straight bridge and does not have function to make a curved shape in the horizontal plan, it has drawback not to be applicable to the curved bridge.

SUMMARY OF THE INVENTION

Accordingly, the present invention is directed to overcome the above-mentioned disadvantages or limitations occurring in the conventional deck module and in the deck constructed using this deck module.

It is an object of the present invention to provide a fiber reinforced polymer composite deck module of tubular profile having a vertical snap-fit connection, a bridge deck assembled using these deck modules, and a deck connector for curved bridge. The bridge deck in accordance with the present invention is assembled to each other in a vertical direction through snap-fit connection so that it improves construction workability and quality, provides deck connection without adhesive bonding; and resolves various problems involving shear connections between deck and girder. Assembling the deck modules with connectors presented in this invention provides bridge deck of a curved shape for the curved bridge.

In order to accomplish this object of the present invention, there is a fiber reinforced polymer composite deck module, comprising an upper plate having an extension at its one side, a lower plate having an extension at its one side opposite to the side of the upper plate, and an interlink plate therebetween, forming therein a plurality of divisional portions of polygonal tubular cross-sectional shape, wherein at one side, including a first interlocking piece protruded downward at the end of the extension of the upper plate and a second interlocking piece protruded downward at a lower outer surface of the interlink plate, and at the other side, including a third interlocking piece protruded upward at an upper outer surface of the interlink plate and a fourth interlocking piece protruded upward at the end of the extension of the lower plate, wherein upon assembling the deck modules with each other, the first and second interlocking pieces of one module are detachably and mechanically snap-fit coupled to the third and fourth interlocking pieces, respectively, of the other module, and wherein the interlocking pieces coupled to each other have protrusions with a shape corresponding to each other for mutual mechanical engagement so that neighboring deck modules are detachably and mechanically snap-fit coupled in a vertical direction to each other to form a deck.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1A:
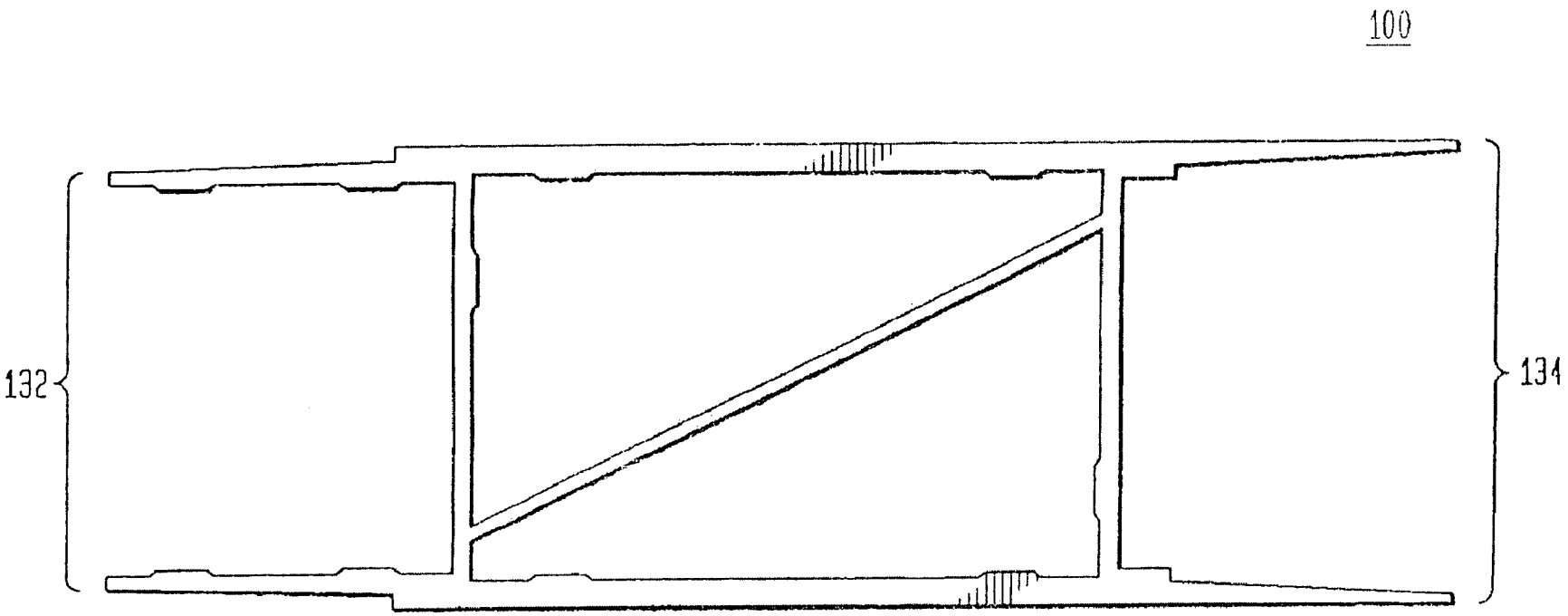
Fig. 1A (Prior Art)
FIGS. 1A and 1B are an end view of a deck module of the prior art and a schematic perspective view of a deck of the prior art, respectively.
Figure 1B:
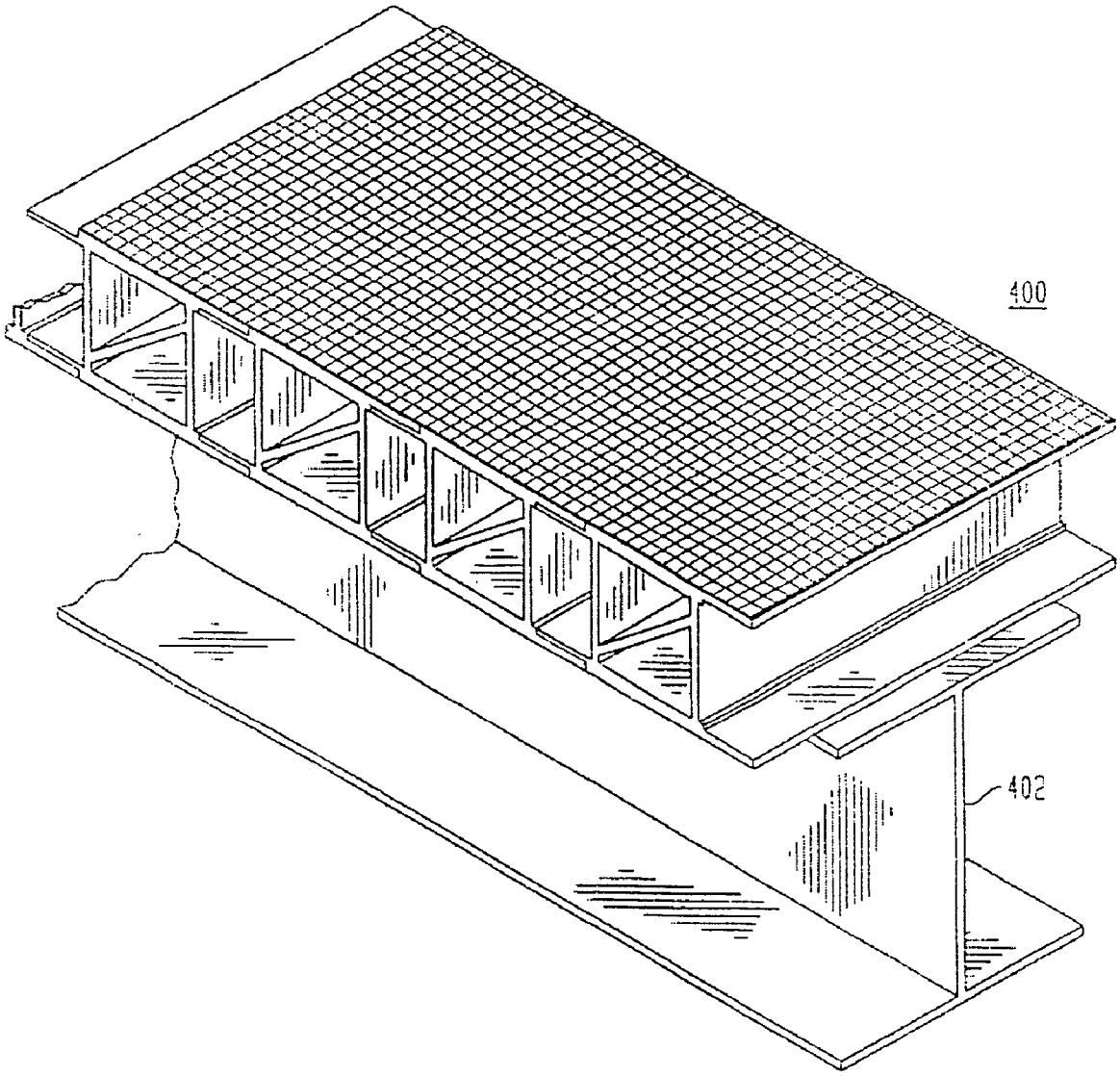
Fig. 1B (Prior Art)

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2A:
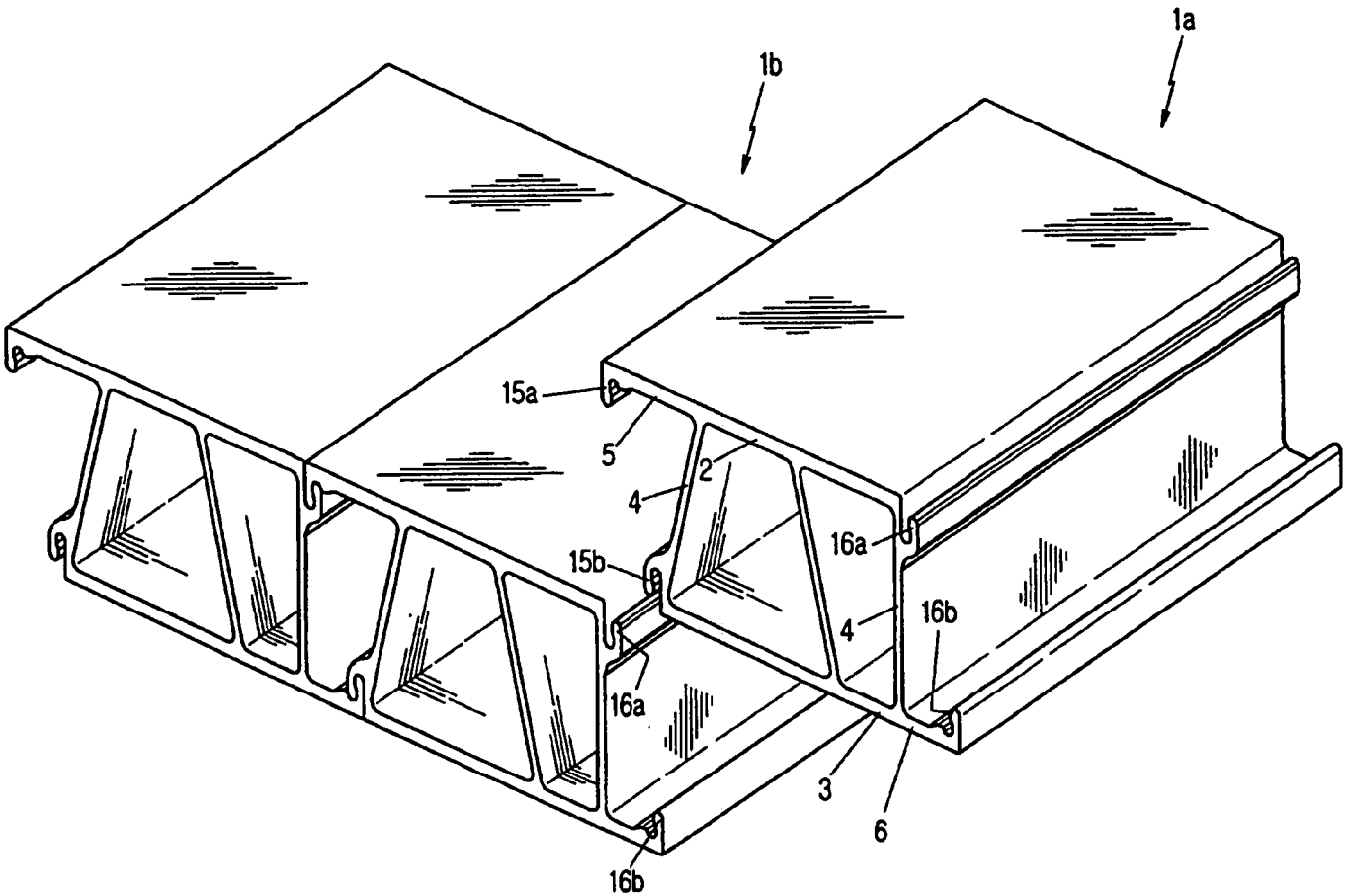
FIGS. 2A and 2B are a perspective view and an end view showing an assembly state, respectively, of a fiber reinforced polymer composite deck module for bridge deck of the present invention.
Figure 2B:
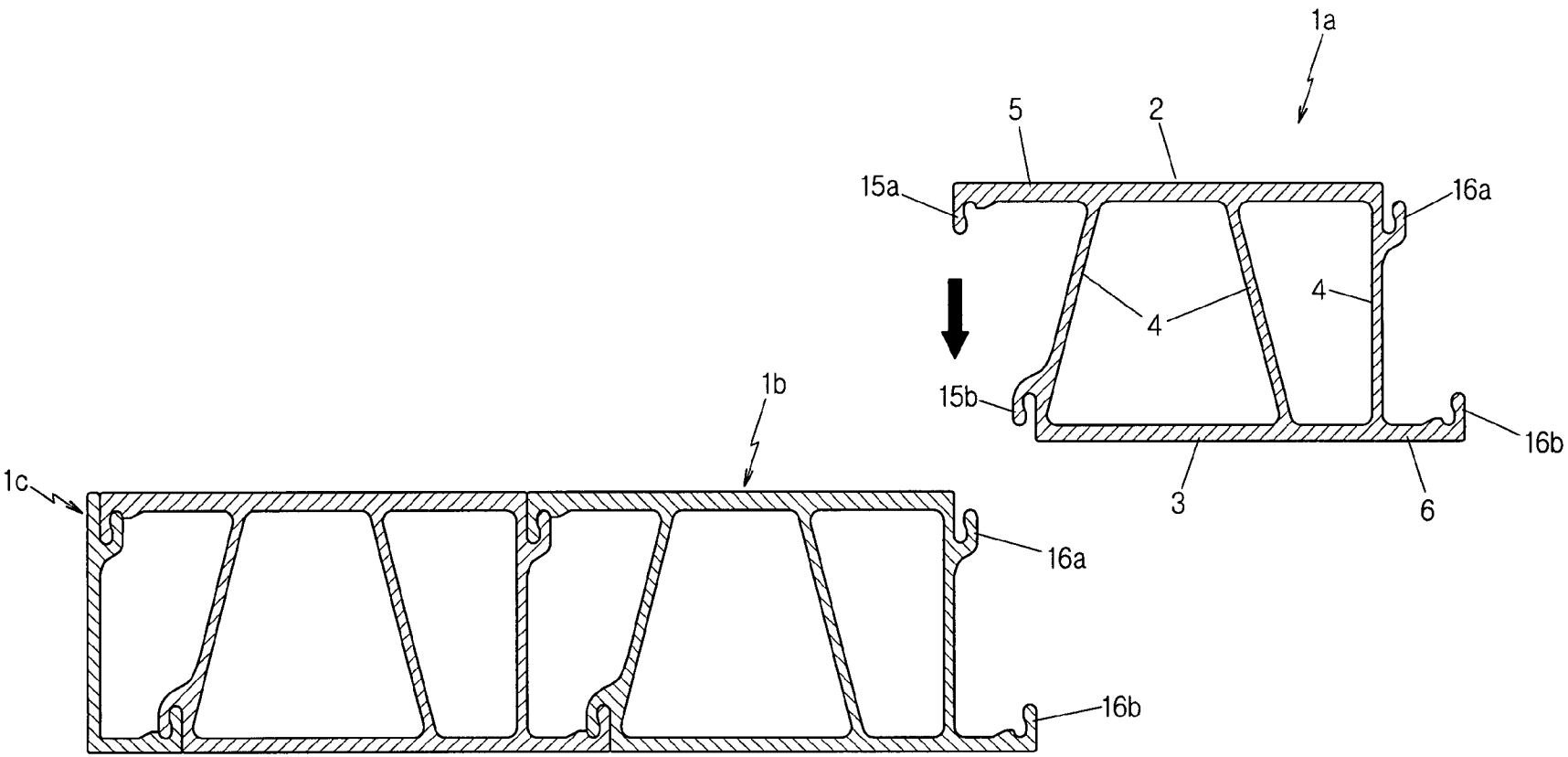

FIGS. 2A and 2B are perspective views of a fiber reinforced composite deck module 1*a* for bridge deck of the present invention and a cross-sectional view showing an assembly status that the deck module 1*a* being assembled with another neighboring deck module 1*b*, respectively. FIGS. 3A to 3D are cross-sectional views showing various shapes of deck modules according to other embodiments of the present invention.

Figure 3A:
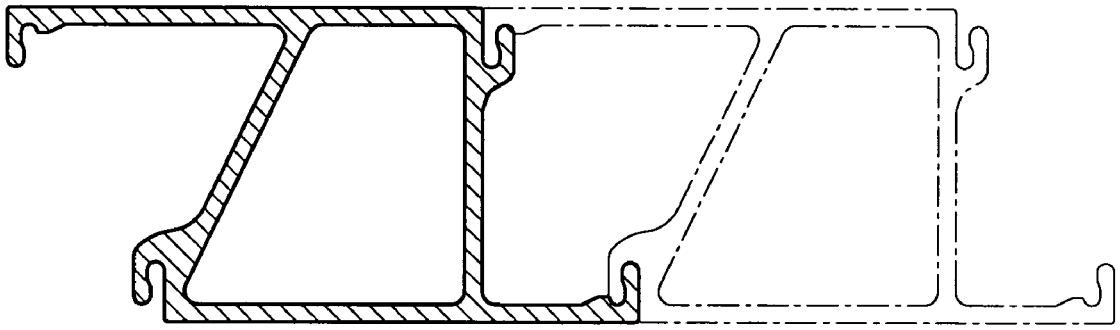
FIGS. 3A to 3D are cross-sectional views showing various shapes of deck modules according to other embodiments of the present invention.
Figure 3B:
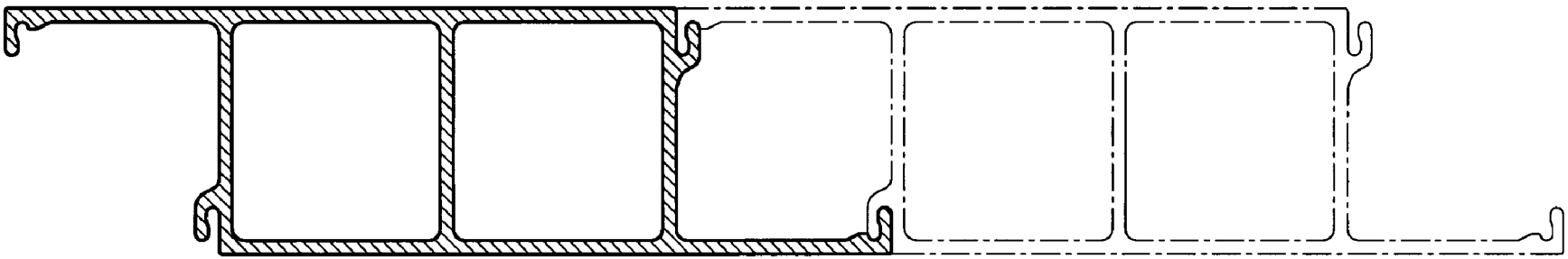
Figure 3C:
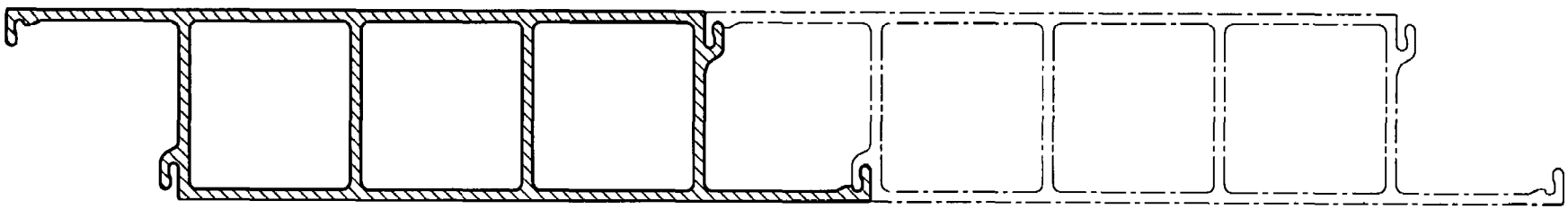
Figure 3D:
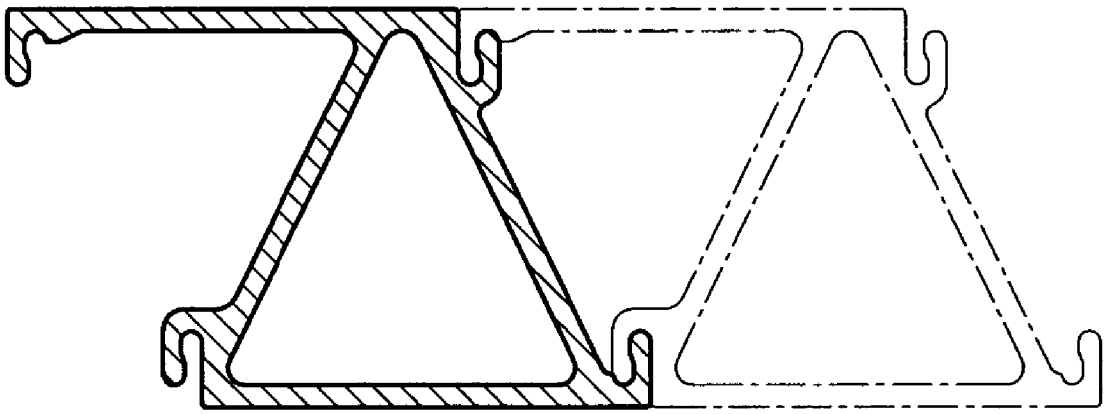

As shown in FIGS. 2A and 2B, the deck module 1*a* comprises an upper plate 2, a lower plate 3 and a web 4 therebetween, thus forming a plurality of polygonal hollow (or tubular) cross-sectional shape. The number of the hollow portion is two as shown in FIGS. 2A and 2B, but may be more than two as shown in FIG. 3C. Also, the hollow portion may have a shape of a trapezoid shown in FIG. 3A, rectangles shown in FIGS. 3B and 3C, and a triangle shown in FIG. 3D. That is, in the present invention, the shape and the number of the hollow portion are not limited to the above, but may be changed variously. The deck module of the fiber reinforced polymer composite materials is composed of reinforcing fibers and resin. The deck module is manufactured by a pultrusion method. The reinforcing fibers may be selected from a group including glass fibers, carbon fibers, aramid fibers and so on, to which the reinforcing fibers are not essentially limited. Various fibers and a combination of the fibers described above can be used as the reinforcing fibers. The resin may be selected from a group including polyester, vinylester, phenol or epoxy.

The deck modules 1*a*, 1*b* having such cross-sectional structure are arranged parallelly in a longitudinal direction at their side portions and integrally assembled, forming a bridge deck. As shown in FIGS. 2A and 2B, the deck module 1*a* of the present invention approaches the neighboring deck module 1*b* vertically and is thereto coupled by a simple and firm mechanical coupling method of snap-fit type. To this end, at one side of the deck module 1*a*, a first interlocking piece 15*a* and a second interlocking piece 15*b* are provided. At the other side of the deck module 1*a*, a third interlocking piece 16*a* and a fourth interlocking piece 16*b* are provided. The first interlocking piece 15*a* of the deck module 1*a* is to be detachably and mechanically coupled in snap-fit type to the third interlocking piece 16*a* of the neighboring deck module 1*b*. The second interlocking piece 15*b* of the deck module 1*a* is to be detachably and mechanically coupled in snap-fit type to the fourth interlocking piece 16*b* of the neighboring deck module 1*b*.

Specifically, in an embodiment illustrated in the drawings, at one side of the deck module 1*a*, an upper extension 5 is formed to extend from the upper plate 2, the first interlocking piece 15*a* is protruded downward at the end of the extension 5 of the upper plate 2, and the second interlocking piece 15*b* is protruded downward at a lower outer surface of the web 4. Meanwhile, at the other side of the deck module 1*a*, the third interlocking piece 16*a* is protruded upward at an upper outer surface of the web 4, a lower extension 6 is formed to extend from the lower plate 3, and the fourth interlocking piece 16*b* is protruded upward at the end of the extension 6 of the lower plate, wherein upon assembling the deck modules with each other, the first and second interlocking pieces 15*a* and 15*b* of one module are detachably and mechanically snap-fit coupled to the third and fourth interlocking pieces 16*a* and 16*b*, respectively, of the other module.

Figure 4A:
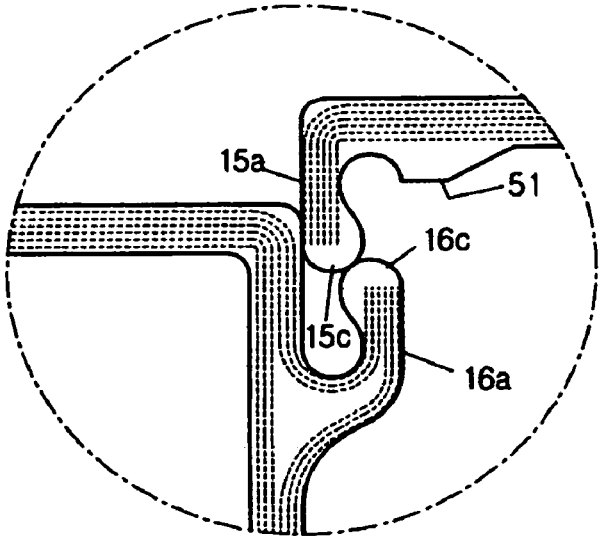
FIGS. 4A–4C are enlarged views showing a coupled shape of coupling protrusions provided to a deck module of the present invention.
Figure 4B:
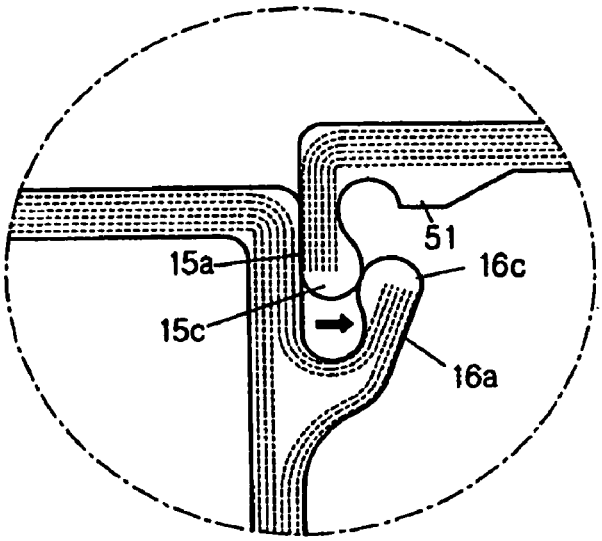
Figure 4C:
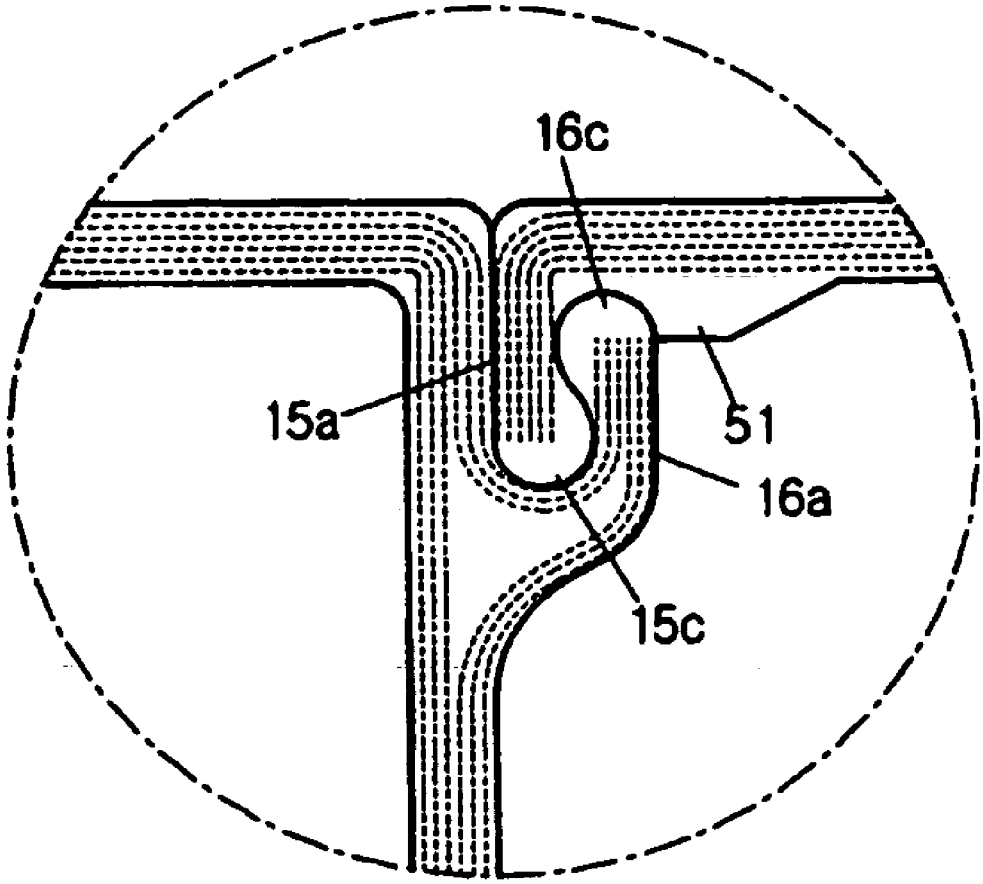

FIGS. 4A–4C is an enlarged view showing a coupling structure between the first interlocking piece 15*a* and the third interlocking piece 16*a* according to an embodiment of the present invention. The first and third interlocking pieces 15*a* and 16*a* have protrusions 15*c* and 16*c*, respectively having a shape corresponding to each other, so that the protrusions 15*c* and 16*c* are engaged with each other to form a firm mechanical coupling. Meanwhile, in order to increase a resistance against a horizontal direction in a state that the protrusions have been coupled to each other, at an inner side of the end of the upper extension 5, a supporting portion 51 is preferably protruded to support the end of the third interlocking piece 16*a* from the back of the third interlocking piece 16*a*. The structure explained above can be similarly adapted to a coupling structure between the second and fourth interlocking pieces 15*b* and 16*b*. Meanwhile, in FIGS. 4A–4C, an example of a shape of transverse fiber arrangement in the protrusions 15*a* and 16*a* is illustrated in dotted lines. In the present invention, fibers can be arranged in the protrusions 15*a*, 16*a*, 15*b* and 16*b* as illustrated in dotted lines, so that even if a shear force is exerted to the protrusions between the deck modules 1*a* and 1*b* a sufficient strength is provided through such fiber arrangement.

In the present invention, the deck module 1*a* is engaged side by side and coupled with the neighboring deck module 1*b* having the corresponding shape, forming a panel structure, i.e., a bridge deck. The deck module 1*a* is not only adapted to the bridge deck, but also to the various panel structures such as bottom and wall portion of water reservoir structures and box culvert, and walls of buildings or underground structures, etc. Specifically, as shown in FIG. 2B, the deck module 1*a* is pressed downwardly toward the neighboring deck module 1*b*. Therefore, the first and the second interlocking pieces 15*a* and 15*b* of the deck module 1*a* are engaged from upside with the third and fourth interlocking pieces 16*a* and 16*b* of the neighboring deck module 1*b*. Thus, both deck modules 1*a* and 1*b* are firmly and mechanically coupled with each other.

Herein, referring to FIGS. 4A and 4C, the first and the third interlocking pieces 15*a* and 16*a* are elastic, and thus, if downward force exceeding a certain level is exerted to the deck module 1*a*, the protrusions 15*c* and 16*c* are slid to each other, and slightly push the third interlocking piece 16*a*, facilitating an easy mechanical coupling between the two protrusions 15*c* and 16*c*. After the slip of protrusions, the first and the third interlocking pieces 15*a* and 16*a* are elastically restored to their original positions so that the protrusions 15*c* and 16*c* are firmly engaged each other as shown in FIG. 4C. Particularly, the deck module of the present invention includes the supporting portion 51 supporting the ends of the third interlocking piece 16*a* at its back side so as to exert a horizontal resistance force.

On the contrary, following from FIG. 4C to FIG. 4A, if the deck module 1*a* is pulled up with an upward force exceeding a certain level, similar to the above, the protrusions 15*c* and 16*c* are slid to each other, and slightly push the third interlocking piece 16*a* toward its back side, facilitating an easy disengagement between the two pieces. Accordingly, the deck module of the present invention can be easily adapted to a bridge deck such as a temporary bridge, military floating bridge and so on. Also, in case when removal of the deck is necessary, such as repair work, the deck module can be easily dissembled.

Figure 5:
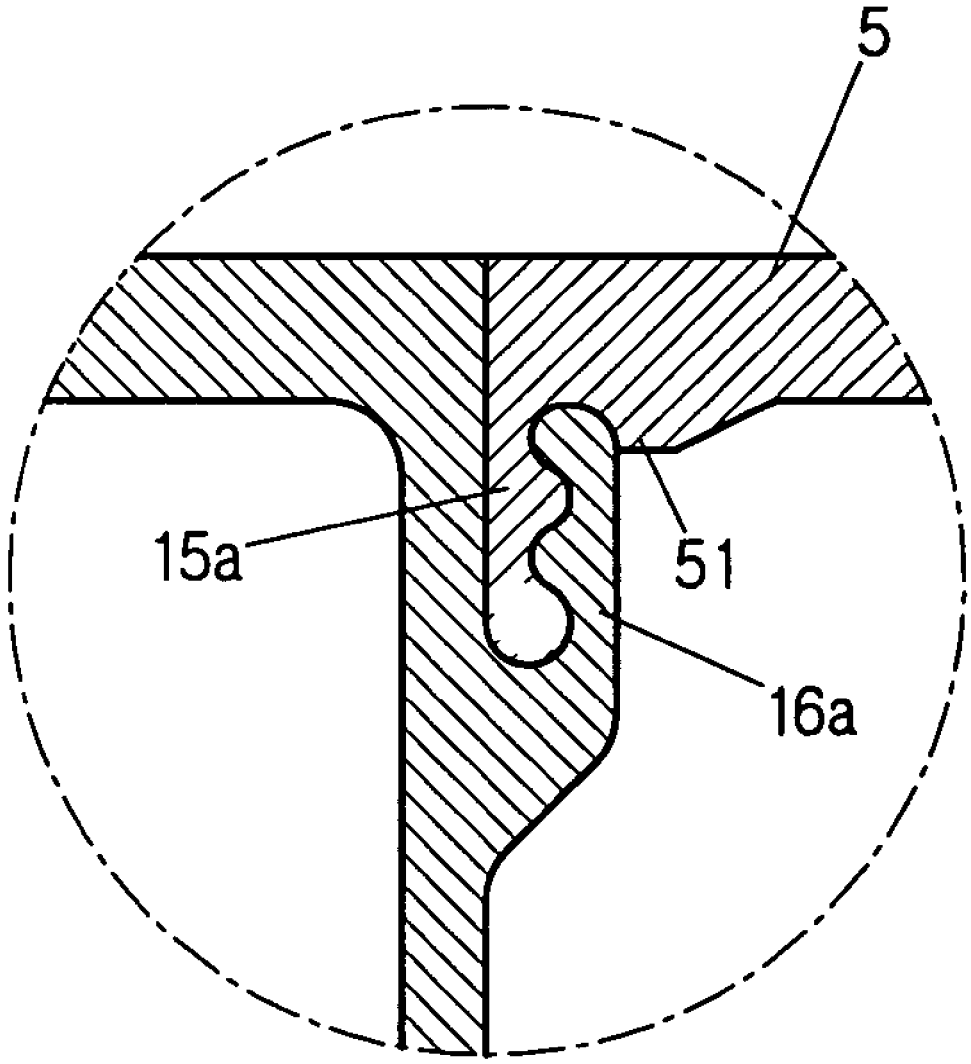
FIG. 5 is an enlarged view showing another embodiment of a coupled shape of coupling protrusions provided to a deck module of the present invention.

FIG. 5 shows another embodiment of the interlocking pieces. As shown in FIG. 5, the interlocking piece may have two protrusions or more than two protrusions. Particularly, if it is not intended to disassemble the deck module later from the module assembly, a user may use an adhesive at the coupled portions of the deck module of the present invention.

Hereinafter, an example of construction method for a girder bridge of composite deck fabricated by use of the deck modules of the present invention will be described with reference to FIGS. 6A through 6C and 7A through 7C.

Figure 6A:
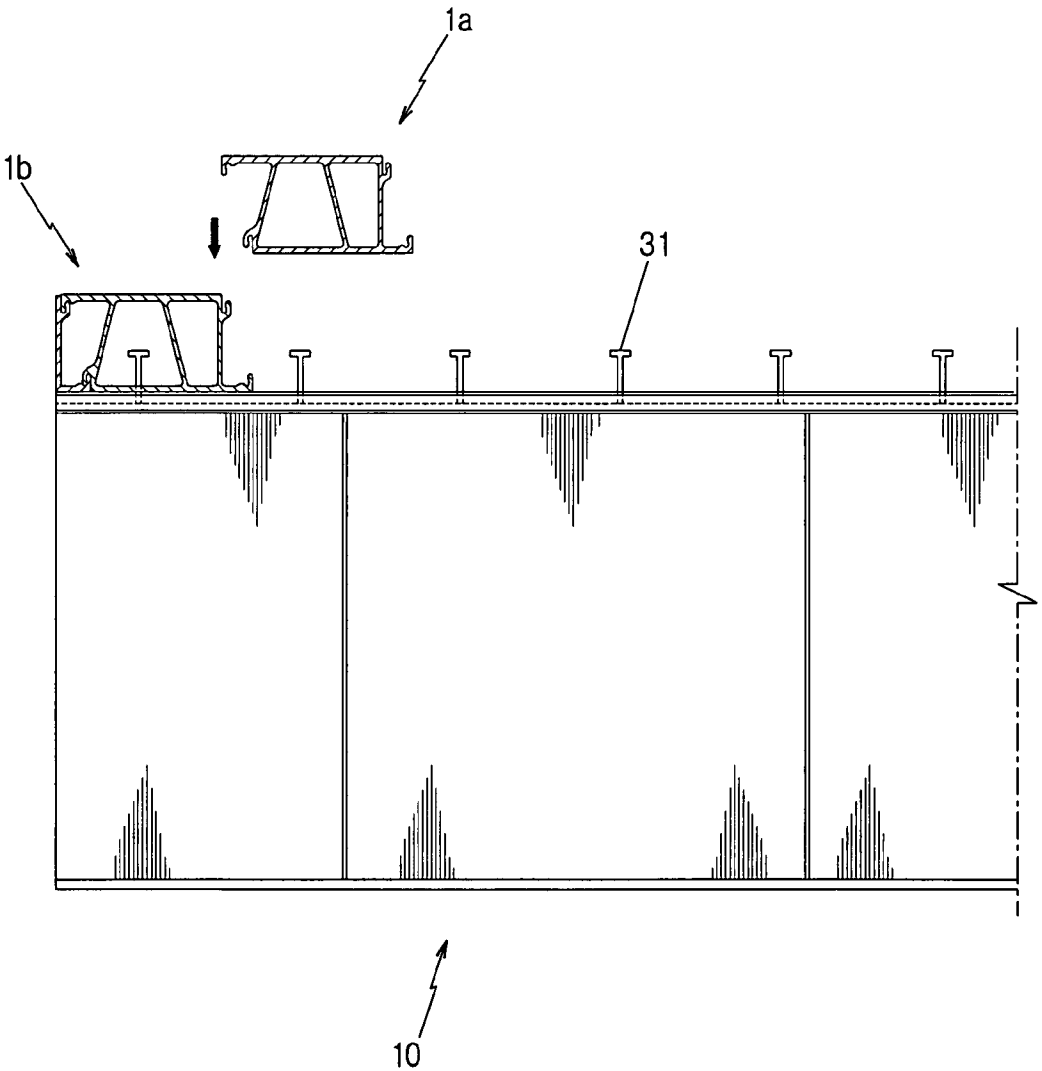
FIGS. 6A to 6C are side views showing an order for constructing a bridge deck through installing a deck module to a steel girder.
Figure 6A:
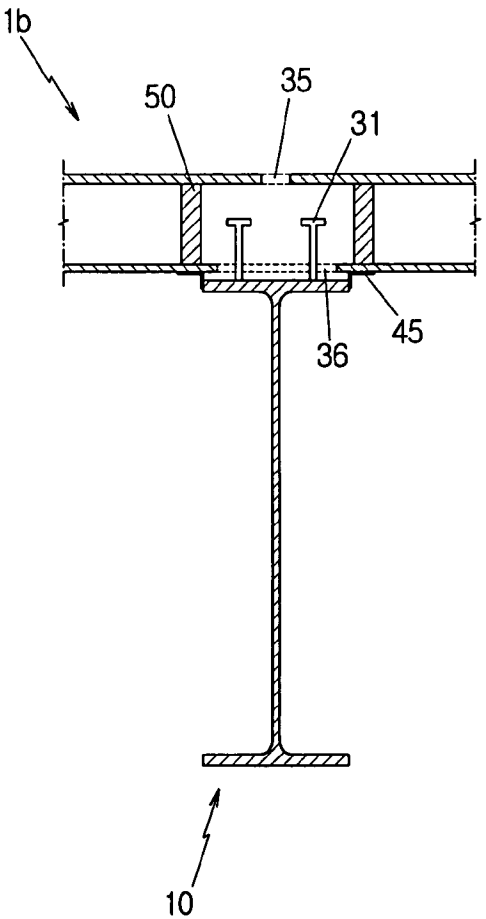
Figure 6B:
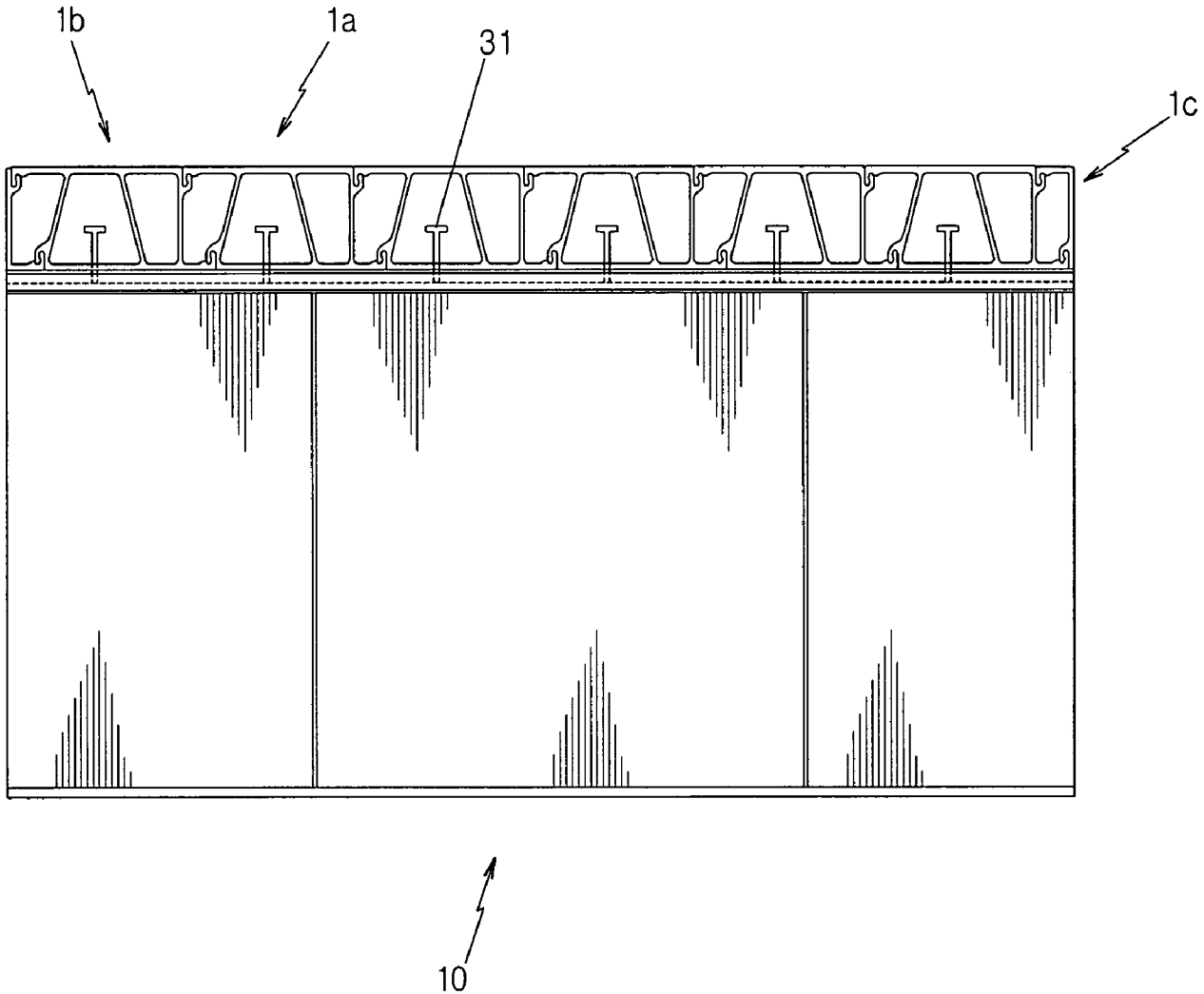
Figure 6C:
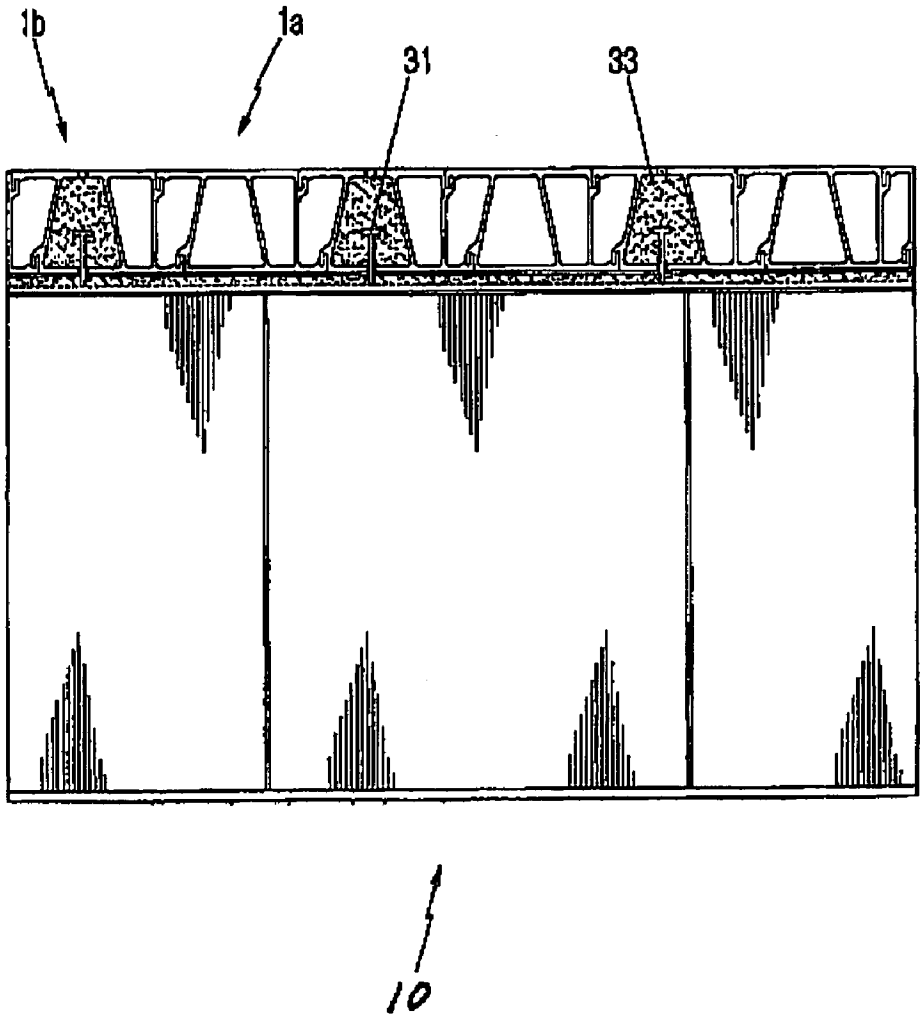
Figure 6D:
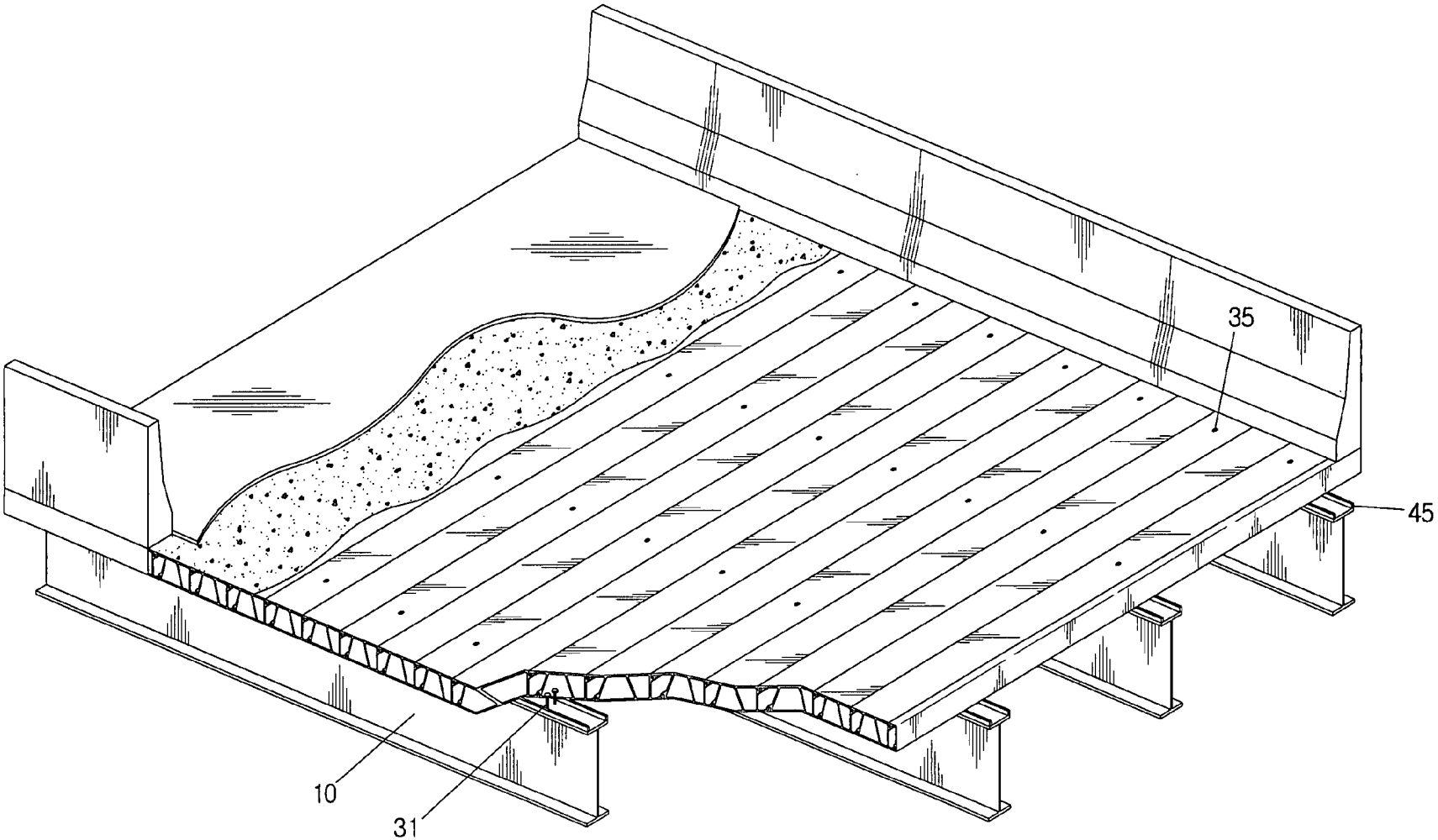
FIG. 6D is a perspective view showing an embodiment of a bridge deck constructed by the orders illustrated in FIGS. 6A to 6C.
Figure 7A:
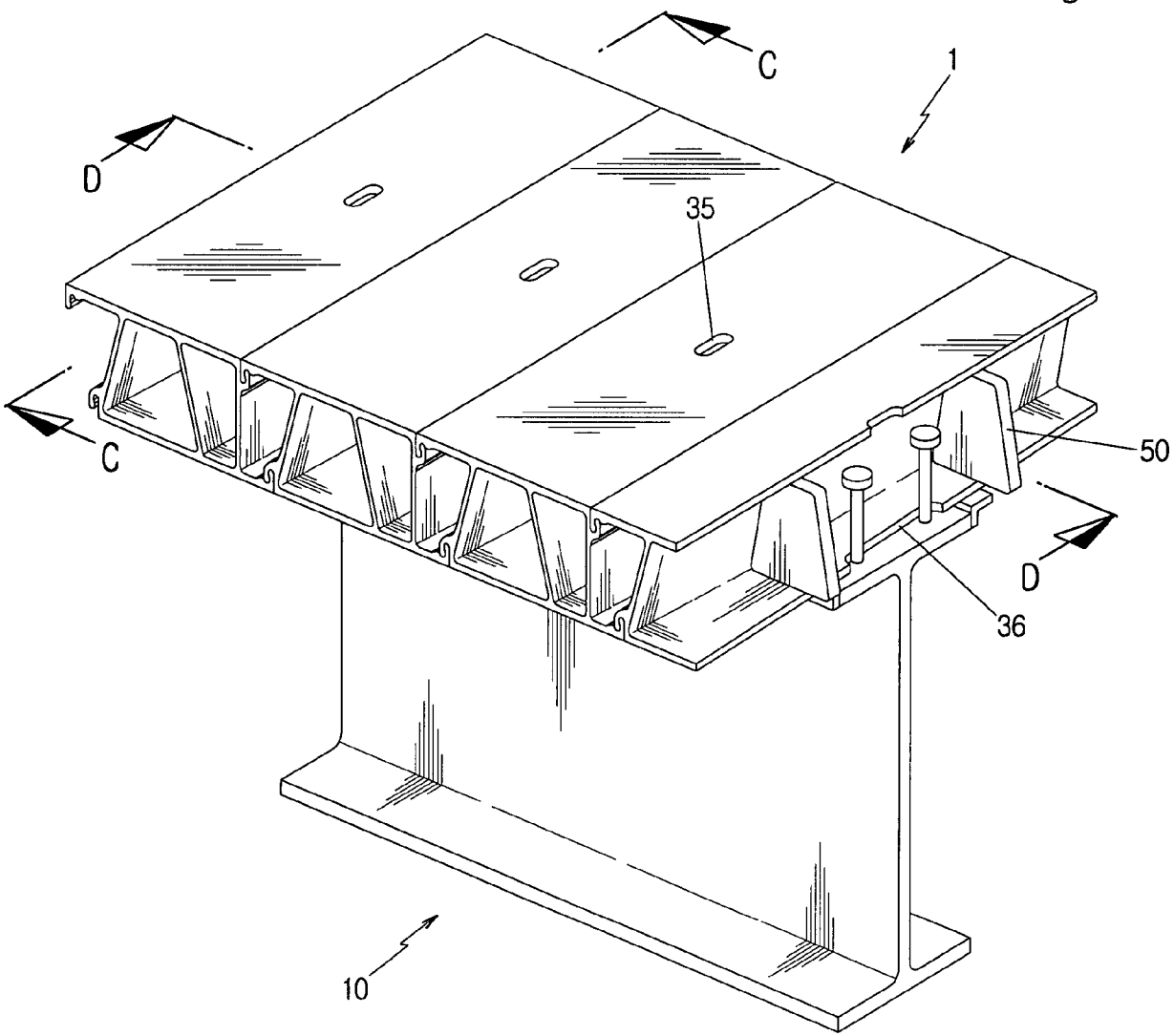
FIG. 7A is a perspective view showing a details of connection between deck modules and a steel girder in accordance with the present invention, in a state that the deck has been constructed by assembling the deck module to the girder.
Figure 7B:
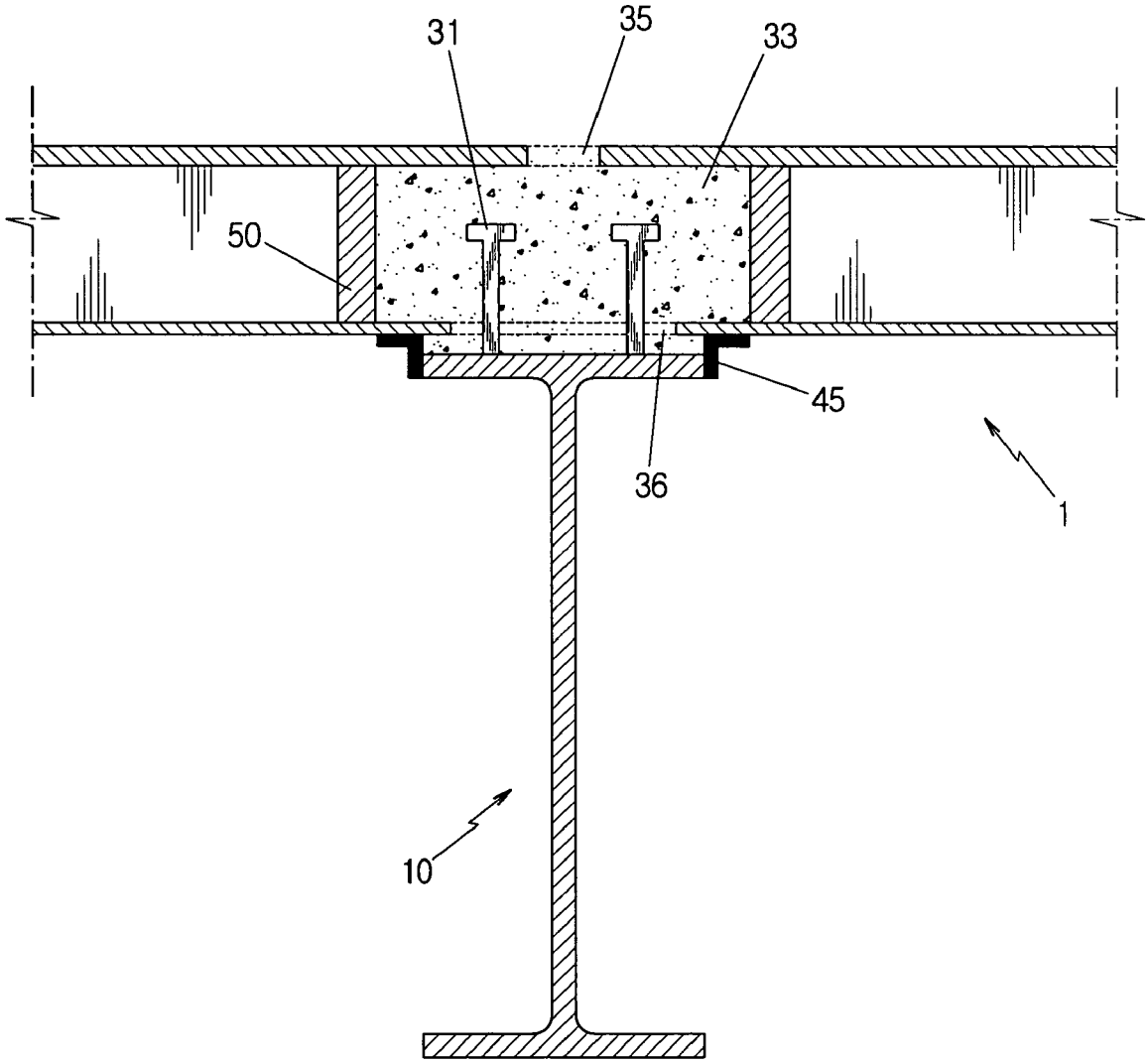
FIG. 7B is a partial cross-sectional view taken along a line C—C of FIG. 7A.
Figure 7C:
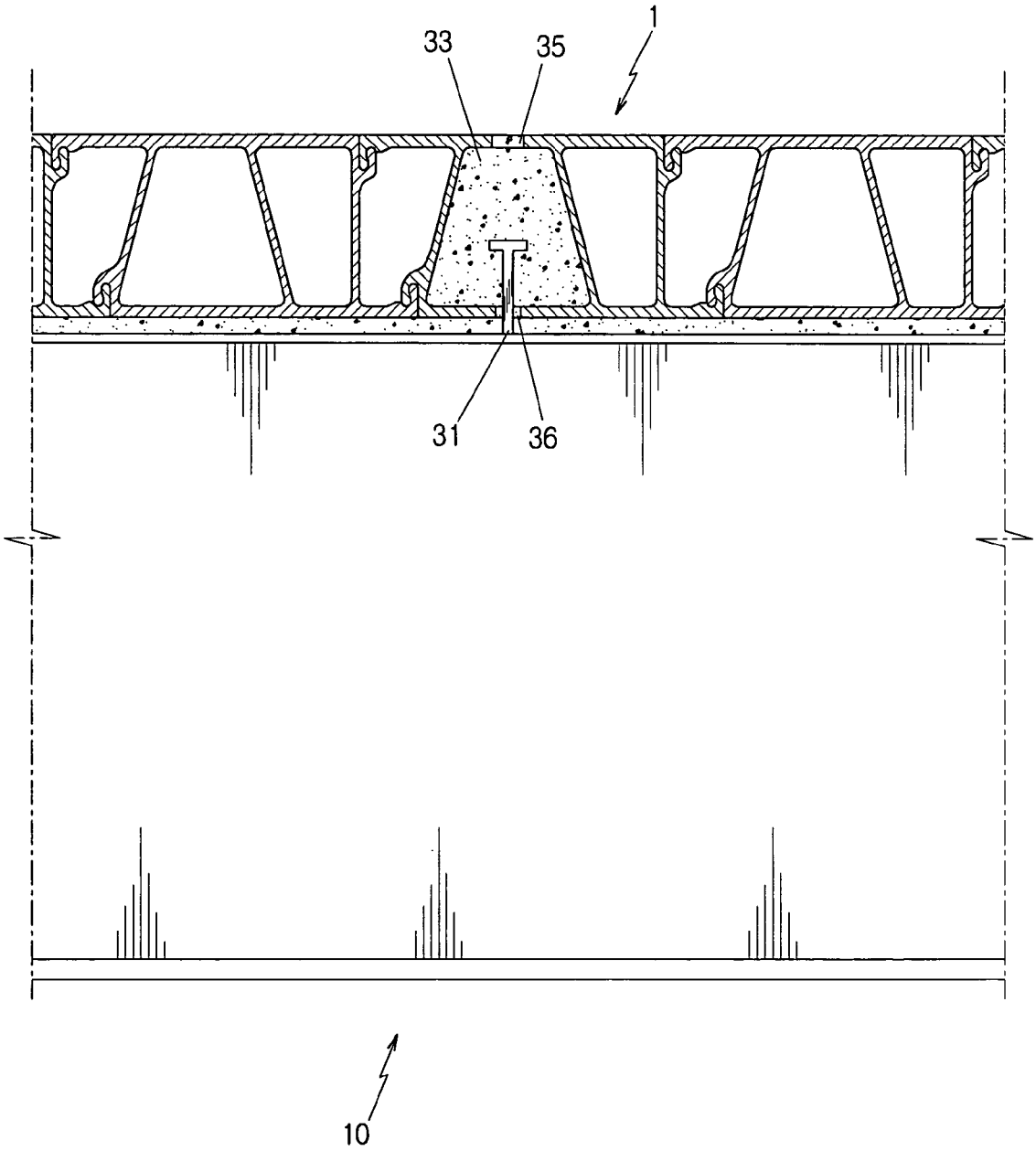
FIG. 7C is a partial cross-sectional view taken along a line D—D of FIG. 7A.
Figure 8:
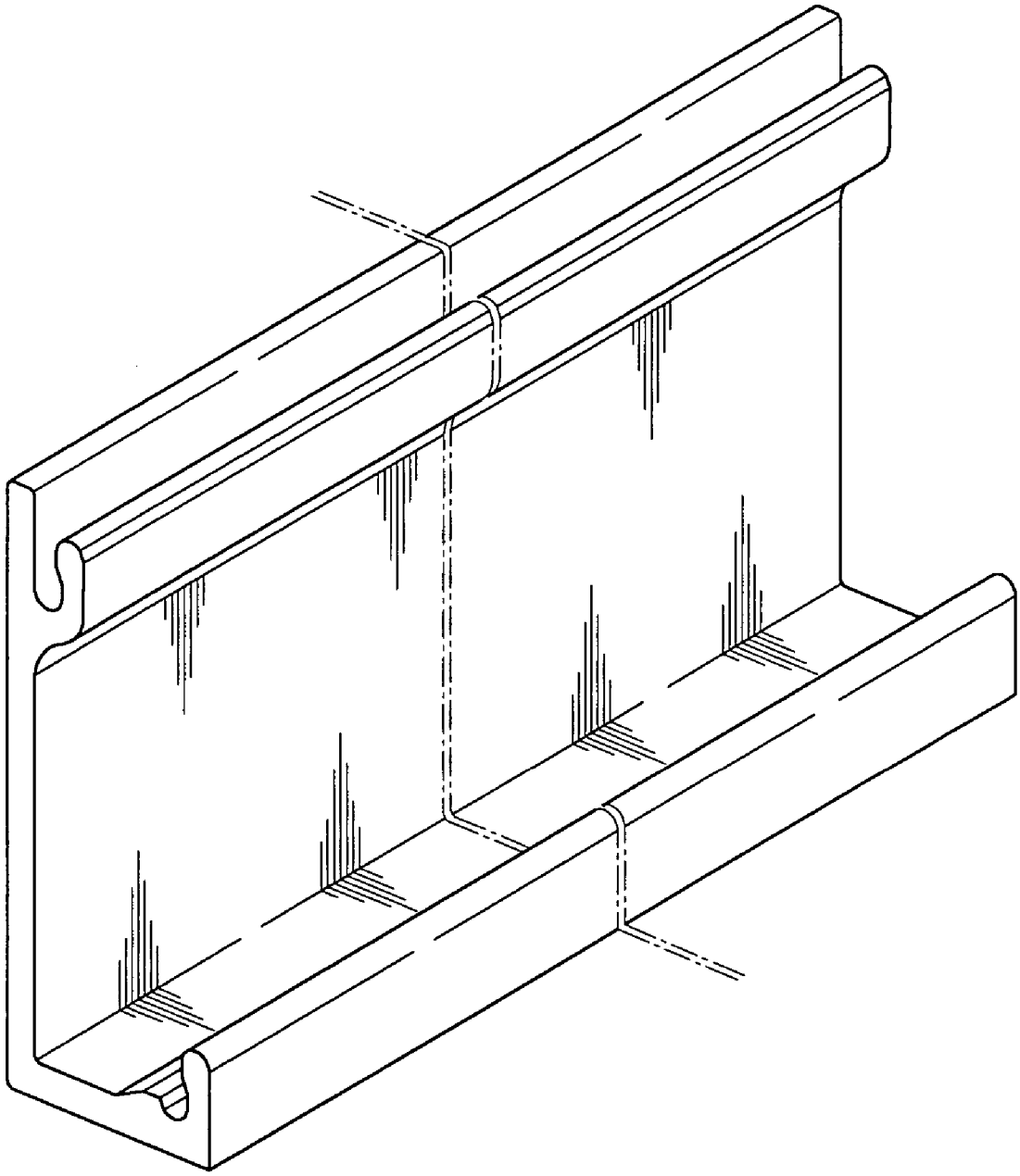
FIG. 8 is a perspective view of a closure deck module to be installed at an outermost side of the deck of the present invention.

FIGS. 6A through 6C are front and cross-sectional views showing an order for constructing a bridge deck through installing deck modules 1*a*, 1*b* to a steel girder 10. FIG. 7A is a perspective view showing details of a connection structure of a deck module 1 of the present invention and a steel girder 10 in a state that the deck has been constructed through installing of the deck module 1 to the girder 10. FIG. 7B is a partial end view taken along a line C—C of FIG. 7A, and FIG. 7C is a partial end view taken along a line D—D of FIG. 7A. FIG. 8 is a schematic perspective view of a closure deck module installed to an outermost side of a deck module of the present invention.

First, a leveling element 45 is installed on the upper flange of the girder 10 on which shear connectors 31 are provided. Two form dams 50 are provided with the inside of the deck module 1*b*. The deck module 1*b* is placed on the leveling element 45. Herein, a hole 36 is formed in the lower plate 3 of the deck module 1*b* at a position corresponding to the shear connectors 31. Therefore, the deck module 1*b* can be placed through the hole 36 on the top of the girder 10 without interfering with the shear connectors 31. The shear connectors 31 are located in a space made by both form dams 50. The space, where the shear connectors 31 are located, are to be filled with mortar to make composite connection with girder. Subsequently, the neighboring deck module 1*a* is arranged at the side of the deck module 1*b* (See FIG. 6A). Herein, the neighboring deck module 1*a* is arranged adjacent to the deck module 1*b* from upside, and then pressed to mechanically couple the two deck modules 1*a* and 1*b* each other (See FIG. 6B).

After coupling the neighboring deck modules 1*a*, 1*b* successively as such, a closure deck module 1*c* is installed as an outermost side deck module. The shape of the closure deck module is illustrated in FIG. 8. If a deck is completely constructed through the coupling of the deck modules, filler materials 33, such as non-shrinkage mortar and so on, are poured in an installing portion of the shear connectors 31 through the hole 35, and then cured (See FIG. 6C).

Since the deck modules of the prior art should be assembled horizontally, the shear connectors cannot be installed beforehand on the girder. Thus, as seen in the description of the prior art, many problems and defects would be caused on installing the shear connector after complete placement of deck panel. However, in the present invention, the deck module is to be placed vertically and pressed from upside, there is no problem even if the shear connectors have already been installed on the girder. Thus, it is not necessary to weld and assemble the shear connectors later through a narrow space, so that an installing work of the shear connectors becomes easy, and time and efforts consumed for the work are reduced. Particularly, a checking of weld state of the shear connectors and a quality control are facilitated.

Figure 9:
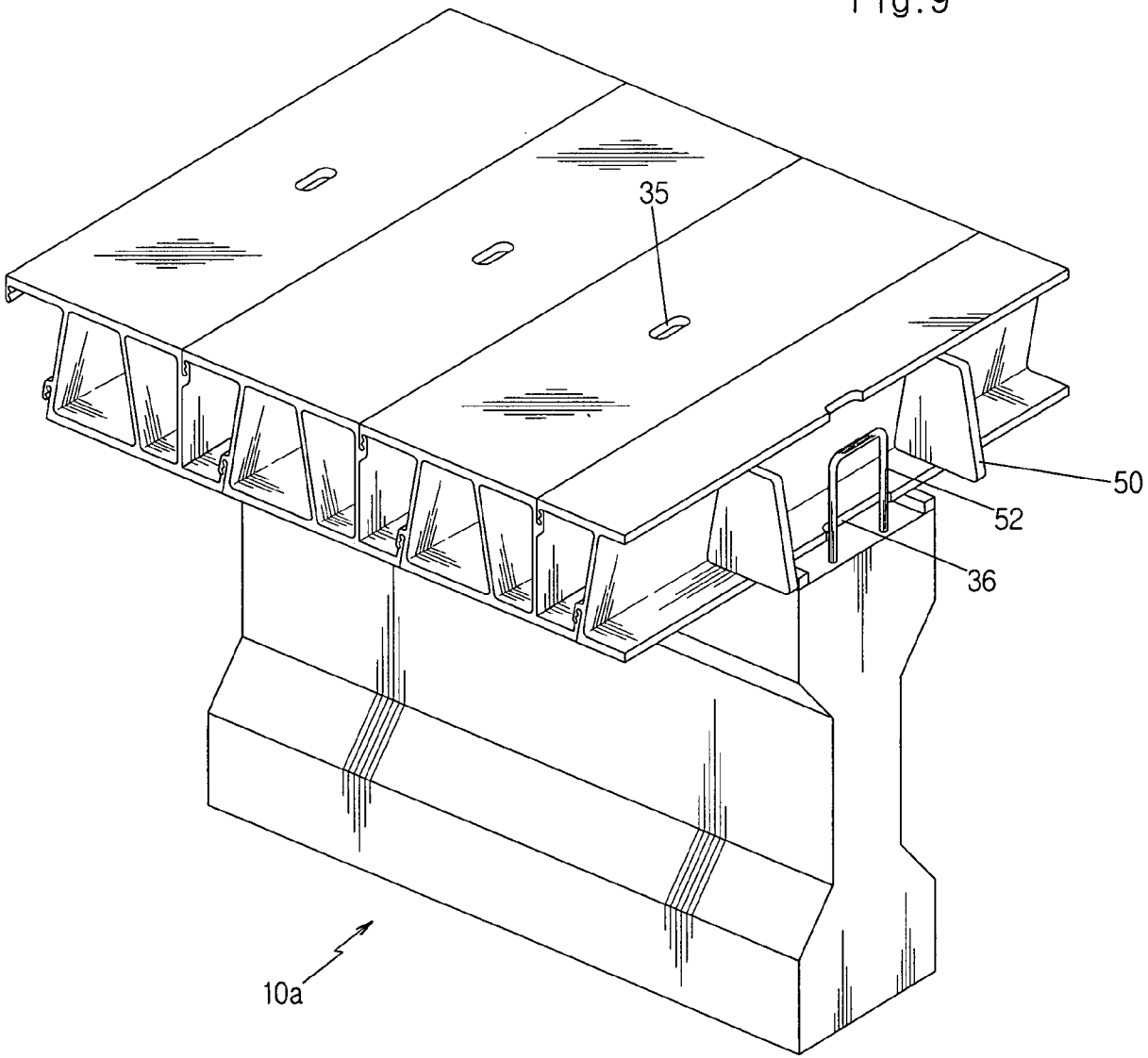
FIG. 9 is a perspective view of a detailed connecting structure of a deck of the present invention and a prestressed concrete girder.

In the present invention, the girder is not limited to the steel girder, but includes various kinds of girders such as reinforced concrete girder, prestressed concrete girder, steel box girder and so on. FIG. 9 is a schematic perspective view of a connection structure between the deck module 1 and the prestressed concrete girder 10*a*. In FIG. 9, the deck module 1 has been installed on the prestressed concrete girder 10*a*. As shown in FIG. 9, in case of the prestressed concrete girder, shear reinforcing bar 52 has already been placed during the construction of the prestressed girder.

In the prior art, there should be a large hole in the upper plate in order to insert the welding tools. However, in the present invention, only a small hole in the upper plate instead of a large hole is enough to pour concrete for girder connection. Therefore, damaged portion of the deck and closing work for the hole can be minimized.

In the prior art, large deck panels should be assembled at the plant and transported to the construction site. However, in the present invention, the deck module 1 can be assembled on the construction site without assembling the deck panel beforehand in a plant. Thus, transportation work in the present invention is easier than that of the prior art, to that the cost for transportation can be reduced. Particularly, the adjustment of leveling space between the upper surface of the girder and the lower portion of the module is easy during the installation of the deck modules since the width of the deck to be assembled in a time is small. Checking the quality of inserting filler material into the leveling space is also easy. Of course, if necessary, the modules are pre-assembled into panels at the site and the panels are finally assembled upon the girder.

In the case of non-composite type girder bridge, according to the present invention, there is no need to fill the space with mortar around shear stud. Thus, assembling and dissembling the deck panel is very easy.

The deck of the present invention can be easily disassembled for the partial repair or reuse. The disassembling method thereof is as follows. First, if the whole deck is disassembled, the connection portion of the shear connector of the girder is disassembled, and the respective deck modules are successively pulled up vertically from the outermost side deck module thus to be disassembled. If a part of the middle of the deck is intended to be disassembled, the corresponding deck module can be disassembled by pushing it in a longitudinal direction.

In addition to the advantages described above, the present invention gives another advantage in that the construction of a curved portion of the deck bridge can also be easily done. Hereinafter, a structure of a deck module for constructing a curved portion of the deck bridge and a method for constructing the curved portion of the deck bridge will be described with reference to FIGS. 10A to 10D.

Figure 10A:
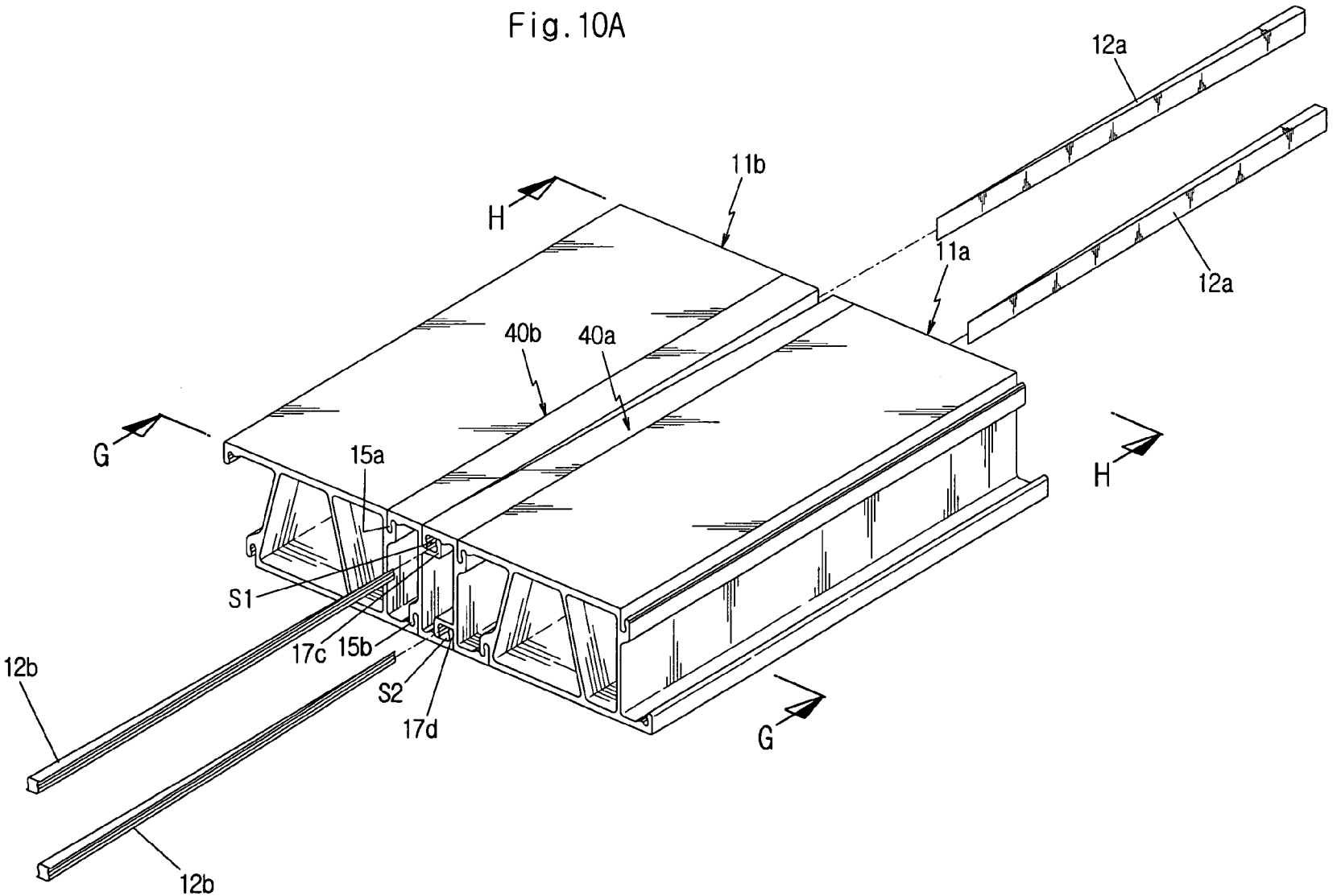
FIG. 10A is a perspective view showing a connecting state of the deck and connector of the present invention for the construction of curved portion of the deck.
Figure 10B:
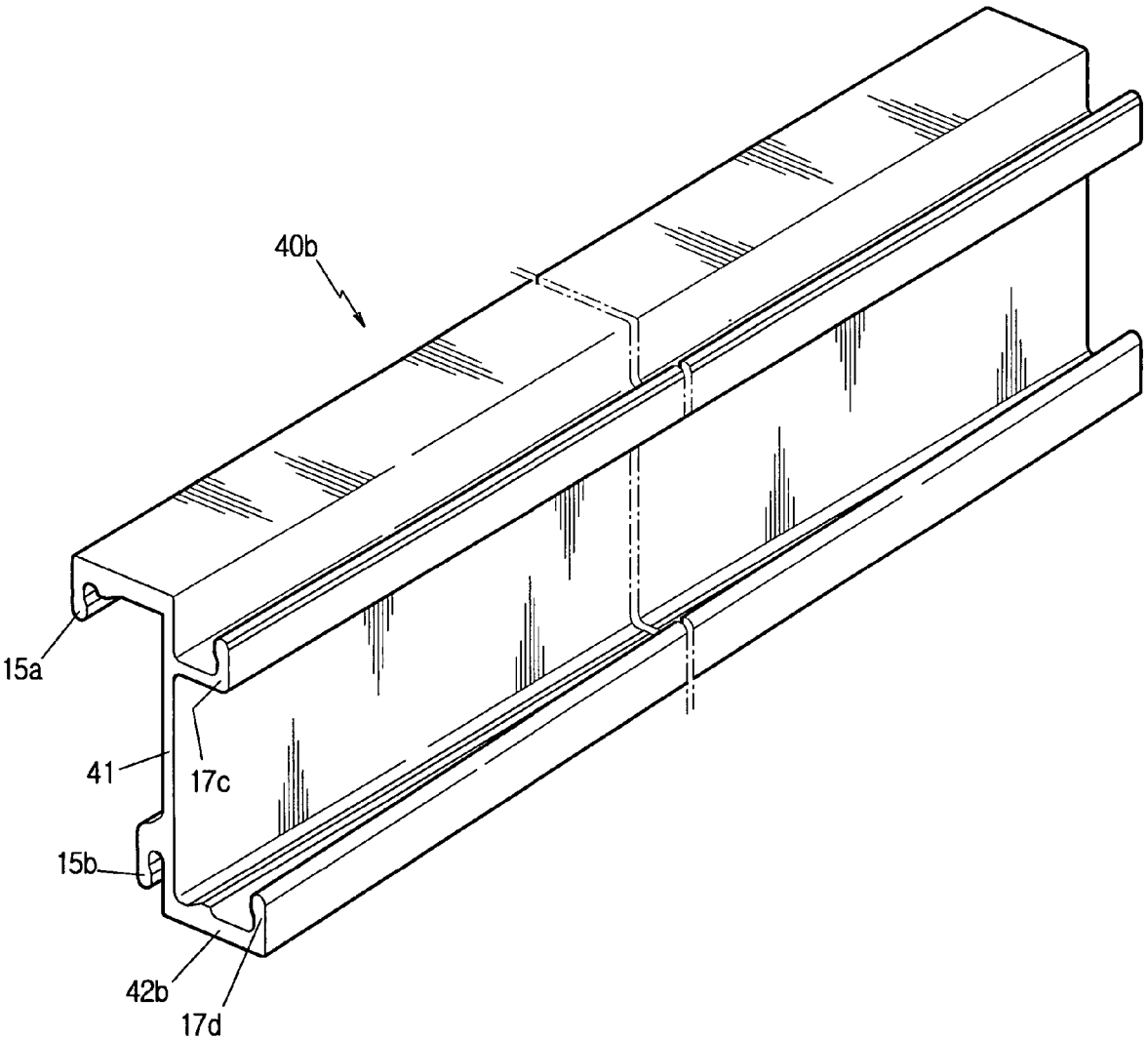
FIG. 10B is a schematic perspective view of a transition curve connector for the construction of a curved portion of the deck.
Figure 10C:
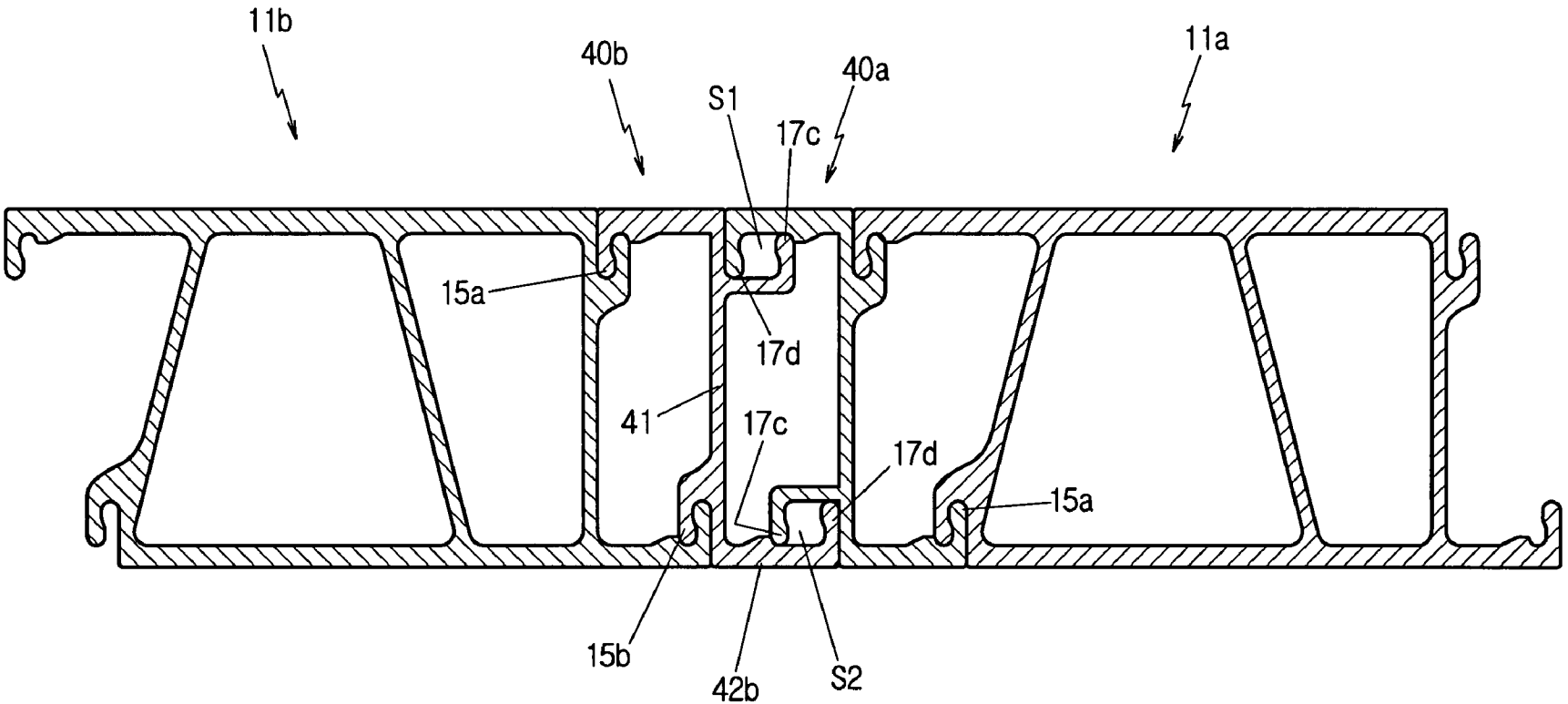
FIG. 10C is a cross-sectional view taken along a line G—G of FIG. 10A.
Figure 10D:
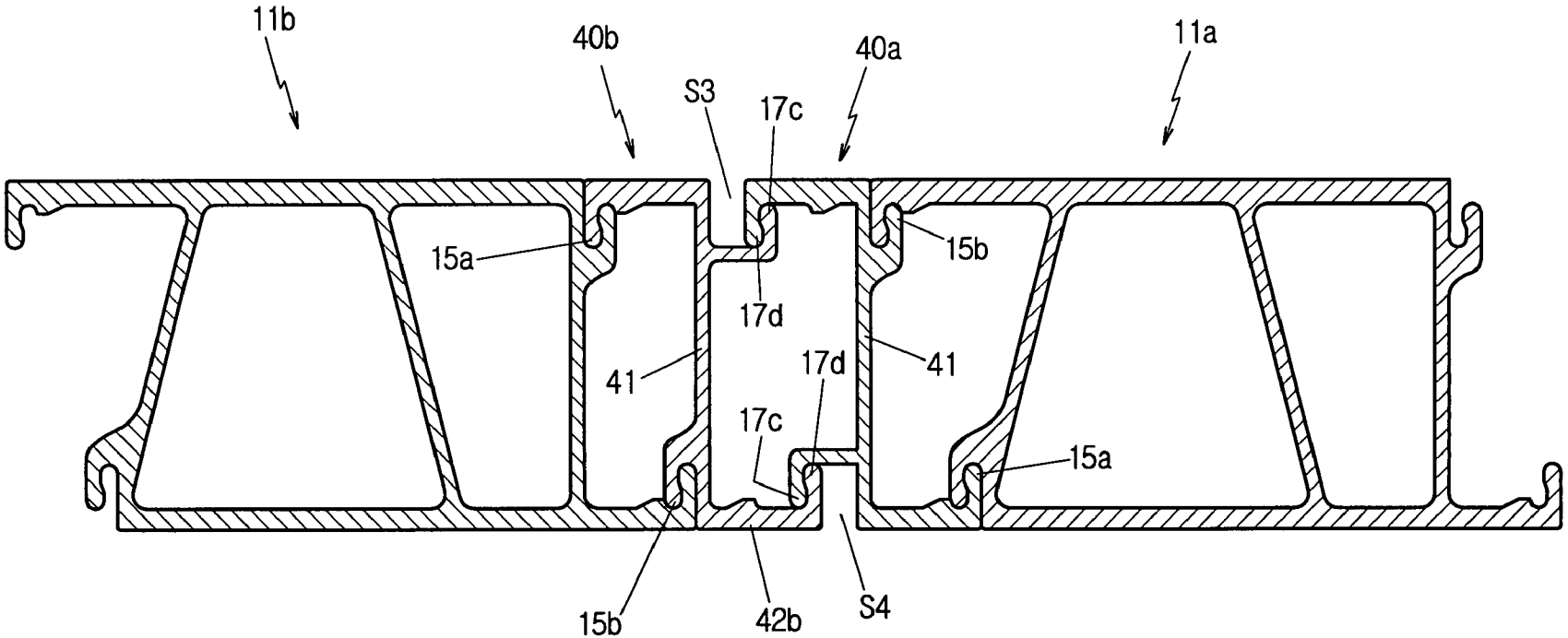
FIG. 10D is a cross-sectional view taken along a line H—H of FIG. 10A.

FIG. 10A is a perspective view showing an assembly of a curved portion of the deck using a deck module of the present invention. FIG. 10B is a schematic perspective view of a transition connector for the curved portion of the deck. FIG. 10C is an end view taken along a line G—G of FIG. 10A. FIG. 10D is an end view taken along a line H—H of FIG. 10A.

As illustrated in the drawings, in order to construct the curved portion of the bridge deck, transition connectors 40*a* and 40*b* are provided between both deck modules 11*a* and 11*b*. The two transition connectors 40*a* and 40*b* have the same shape. The transition connectors 40*a* and 40*b* are coupled to both deck modules 11*a* and 11*b*, respectively, in a state that they turn upside down to each other, and are directly coupled to each other at one of their sides.

As illustrated in FIG. 10B, a first transition connector 40*b* has coupling protrusions at both sides of a vertical web 41. Another transition connector is to be coupled to the first side of the web 41. A fifth interlocking piece 17*c* is provided to be protruded upward at the upper part of a first side of the web 41. Gap with a certain width is formed between the fifth interlocking piece 17*c* and the web 41. At the lower part of the first side of the web 41, a lower horizontal extension 42*b* is extended horizontally. The lower horizontal extension 42*b* has a sixth interlocking piece 17*d* protruded upward at its end. The deck module 11*b* is coupled to the second side of the web 41. At the second side of the web 41, the first and the second interlocking pieces 15*a* and 15*b* to be respectively coupled to the coupling protrusions of the deck module 11*b* are provided. The first and the second interlocking pieces 15*a* and 15*b* have the same structure as that of the deck module mentioned previously.

The other transition connector, i.e., a second transition connector 40*a* to be coupled to the neighboring deck module 11*a* has the same construction as that of the first transition connector 40*b* except that it is coupled to the deck module 11*a* in a state of being turned upside down in comparison with the first transition connector 40*b*. That is, in the second transition connector 40*a* as illustrated in the drawing, the fifth and the sixth interlocking pieces 17*c* and 17*d* thereof are protruded downward.

A curved portion of the deck is constructed by coupling the first and the second transition connectors 40*b* and 40*a* to each other between the deck modules 11*b* and 11*a* The first transition connector 40*b* is coupled with the deck module 11*b*, and the second transition connector 40*a* is also coupled with another deck module 11*a*. The first and the second interlocking pieces 15*a* and 15*b* of the first transition connector 40*b* are respectively coupled to the corresponding third and the fourth interlocking pieces of the left side deck module 11*b*.

When the transition connectors 40*b* and 40*a* are coupled to the deck modules 11*b* and 11*a*, respectively, the deck modules 11*b* and 11*a* form a slightly curved shape. On coupling the transition connectors 40*b* and 40*a*, at an inner side of a curved portion of the deck as shown in FIGS. 10A and 10C, the sixth interlocking piece 17*d* of the second transition connector 40*a* is coupled to the fifth interlocking piece 17*c* of the first transition connector 40*b*. Simultaneously, the sixth interlocking piece 17*d* of the second transition connector 40*a* contacts with the first side of the web 41 of the first transition connector 40*b*. Thus, there is an inner space S1 between the sixth interlocking piece 17*d* of the second transition connector 40*a* and the fifth interlocking piece 17*c* of the first transition connector 40*b*.

Similarly, the fifth interlocking piece 17*c* of the second transition connector 40*a* is coupled to the sixth interlocking piece 17*d* of the first transition connector 40*b*. Simultaneously, the six interlocking piece 17*d* of the first transition connector 40*b* contacts with the second side of the web 41 of the second transition connector 40*a* Thus, there is an inner space S2 between the fifth interlocking piece 17*c* of the second transition connector 40*a* and the sixth interlocking piece 17*d* of the first transition connector 40*b*.

On the contrary, on the outer side of the curved portion of the deck as illustrated in FIG. 10D, the sixth interlocking piece 17*d* of the second transition connector 40*a* and the fifth interlocking piece 17*c* of the first transition connector 40*b* are coupled to each other. Thus, there is an open space S3 between the sixth interlocking piece 17*d* of the second transition connector 40*a* and the web 41 of the first transition connector 40*b*. The fifth interlocking piece 17*c* of the second transition connector 40*a* and the sixth interlocking piece 17*d* of the first transition connector 40*b* are coupled to each other. Thus, there is an open space S4 between the sixth interlocking piece 17*d* of the first transition connector 40*b* and the web 41 of the second transition connector 40*a*.

As shown in FIG. 10A, fixing wedge members 12*a* have shapes corresponding to those of the open spaces S3 and S4, and they extend laterally. The fixing wedge members 12*a* are inserted into the open spaces S3 and S4, respectively, and thus firmly maintain the coupling of the interlocking pieces 17*c* and 17*d*. Of course, fixing wedge members 12*b* are respectively inserted into the spaces S1 and S2. Meanwhile, the fixing wedge members 12*a* to be inserted into the spaces S3 and S4 can be a tapered shape section in which an upper portion thereof is narrower than a lower portion thereof. Such tapered shape section prevents the fixing wedge members from being separated upward and downward. If the deck modules are successively coupled as described above, the curved portion of the deck can be constructed.

As can be seen from the above, according to the present invention, a bridge deck can be constructed by coupling the fiber reinforced composite deck modules. According to the present invention, since a deck module is made of fiber reinforced polymer composite with high corrosion resistance and high durability, the problems of the prior art such as deterioration of concrete and corrosion of steel reinforcement in the reinforced concrete bridge deck can be essentially solved. Therefore, life span of the bridge deck can be increased two to three times that of the conventional reinforced concrete deck. Also, since composite deck is durable, it may be expected that maintenance costs are considerably reduced in comparison with the conventional reinforced concrete deck.

According to the present invention, in case of upgrading the concrete deck bridge, the conventional reinforced concrete decks are removed and the composite deck modules are to be substituted. In this case, dead load of the deck can be reduced by more than 50% because heavy concrete decks are substituted with lightweight composite decks. This facilitates upgrade of the bridge because the bridge becomes to have an increased load carrying capability by the amount corresponding to the reduced dead load. Further, it is viable to economically construct a new bridge since slender superstructure and substructure are possible due to lightweight composite decks.

The bridge deck described in the specification including claims does not essentially mean only a deck installed in a bridge, but it should be understood to include all of decks adapted to civil and architectural constructions, which are supported by a girder or beam. Also, the deck modules of the present invention are coupled to each other to form a wall type construction, so that its use cannot be limited to the above deck. That is, the deck modules of the present invention can be adapted to various constructions such as reservoir, tank, platform, footway, box culvert and so on. Accordingly, in the specification including claims, the deck should be understood to mean a wall type construction.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A fiber reinforced polymer composite deck module comprising:

an upper plate having an upper extension at one side, a lower plate having a lower extension at one side opposite to the side of the upper plate, and a web disposed between the upper and lower plates to form a plurality of divisional portions of polygonal tubular cross-sectional shape between the upper and lower plates, wherein at one side, a first interlocking piece protrudes downward at the end of the extension of the upper plate and a second interlocking piece protrudes downward at a lower outer surface of the web, and at the other side, a third interlocking piece protrudes upward at an upper outer surface of the web and a fourth interlocking piece protrudes upward at the end of the extension of the lower plate, wherein the first interlocking piece is disposed further from the web than the second interlocking piece and the fourth interlocking piece is disposed further from the web than the third interlocking piece, wherein upon assembling the deck modules with each other, the first and the second interlocking pieces of one module are detachably and mechanically snap-fit coupled to the third and the fourth interlocking pieces of another module, and wherein the interlocking pieces coupled to each other have protrusions with a shape corresponding to each other configured for mutual mechanical engagement so that neighboring deck modules are detachably and mechanically snap-fit coupled in a vertical direction to each other to form a deck.

2. A fiber reinforced polymer composite deck module as claimed in claim 1, wherein at an inner side of the end of the upper extension, a supporting portion protrudes configured to support the leading end of the third interlocking piece from the back of the third interlocking piece, and at an inner side of the end of the lower extension, a recess is formed so that another supporting portion protrudes configured to support the leading end of the second interlocking piece from the back of the second interlocking piece when the second and the fourth interlocking pieces are coupled to each other, whereby the interlocking pieces are coupled through increasing a resistance force against a horizontal direction.

3. A fiber reinforced polymer composite deck module as claimed in claim 2, further comprising a curve transition connector at the other side of the deck module in order to be used to construct a curved portion of the deck, wherein the curve transition connector has interlocking pieces provided at both faces of a web, wherein at one face of the web, a fifth interlocking piece protrudes upward at the upper side of the web so that a gap with a certain width is formed between the fifth interlocking piece and the web, and at the lower side of the web, a lower horizontal extension extends horizontally and has a sixth interlocking piece protruding upward at its end, wherein at the other face of the web, the first and the second interlocking pieces configured to be respectively coupled to the coupling protrusions of the deck module are provided, and wherein the curved portion of the deck is constructed by coupling and assembling the first and the second interlocking pieces of the curve transition connector to the interlocking pieces provided at the other side of the deck module and by coupling and assembling the fifth and the sixth interlocking pieces of the curve transition connector to the fifth and the sixth interlocking pieces of another curve transition connector.

4. A bridge deck constructed by assembling fiber reinforced polymer composite deck modules side by side, wherein each deck module comprises an upper plate having an upper extension at one side, a lower plate having a lower extension at one side opposite to the side of the upper plate, and an web disposed between the upper and lower plates to form a plurality of divisional portions of polygonal tubular cross-sectional shape between the upper and lower plates, wherein each deck module includes, at one side, a first interlocking piece protruding downward at the end of the extension of the upper plate and a second interlocking piece protruding downward at a lower outer surface of the web, and at the other side, a third interlocking piece protruding upward at an upper outer surface of the web and a fourth interlocking piece protruding upward at the end of the extension of the lower plate, wherein the first interlocking piece is disposed further from the web than the second interlocking piece and the fourth interlocking piece is disposed further from the web than the third interlocking piece, wherein upon assembling the deck modules with each other, the first and the second interlocking pieces of one module are detachably and mechanically snap-fit coupled to the third and the fourth interlocking pieces, respectively, of another module, and wherein the interlocking pieces have protrusions with a shape corresponding to each other configured for mutual mechanical engagement so that a deck module is detachably and mechanically snap-fit coupled in a direction perpendicular to the upper plate to a neighboring deck module to form the deck.

5. A bridge deck as claimed in claim 4, wherein at an inner side of the end of the upper extension of the deck module, a supporting portion protrudes configured to support the leading end of the third interlocking piece from the back of the third interlocking piece, and at an inner side of the end of the lower extension of the deck module, a recess is formed so that another supporting portion protrudes configured to support the leading end of the second interlocking piece from the back of the second interlocking piece when the second and the fourth interlocking pieces are coupled to each other, whereby the interlocking pieces are coupled through increasing a resistance force against a horizontal direction.

6. A bridge deck as claimed in claim 4, further comprising a first and a second transition connector at the sides of the deck modules, respectively, wherein the transition connector has interlocking pieces provided at both faces of a vertical web, wherein at one face of the web, a fifth interlocking piece protrudes upward at the upper side of the web so that a gap with a certain width is formed between the fifth interlocking piece and the web, and at the lower side of the web, a lower horizontal extension extends horizontally and has a sixth interlocking piece protruding upward at its end, wherein at the other face of the web of the first transition connector, the first and the second interlocking pieces configured to be respectively coupled to the coupling protrusions of the deck module are provided so that the first and the second interlocking pieces of the first transition connector are respectively coupled to the interlocking pieces provided at the other side of the deck module, wherein at one side of the neighboring deck module, a second transition connector is coupled, the second transition connector having the same construction as that of the first transition connector except it being coupled to the deck module in a state of being turned upside down in comparison with the first transition connector, wherein when the transition connectors are coupled to the deck modules, respectively, the deck modules are coupled in a slightly tilted position to each other to form a curved portion of the deck, and at an inner side of the curved portion of the deck, a sixth interlocking piece of the second transition connector is coupled to the fifth interlocking piece of the first transition connector so that the sixth interlocking piece of the second transition connector is installed to contact the outer side face of the web of the first transition connector, thereby forming an inner space between the sixth interlocking piece of the second transition connector and the fifth interlocking piece of the first transition connector, wherein the fifth interlocking piece of the second transition connector is coupled to the sixth interlocking piece of the first transition connector so that the sixth interlocking piece of the first transition connector contacts the outer side face of the web of the second transition connector, thereby forming an inner space between the fifth interlocking piece of the second transition connector and the sixth interlocking piece of the first transition connector, wherein at an outer side of the curved bridge, the sixth interlocking piece of the second transition connector and the fifth interlocking piece of the first transition connector are coupled to each other, forming an open space between the sixth interlocking piece of the second transition connector and the web of the first transition connector, wherein the fifth interlocking piece of the second transition connector and the sixth interlocking piece of the first transition connector are coupled to each other, forming an open space between the sixth interlocking piece of the first transition connector and the web of the second transition connector, and wherein fixing wedge members are inserted into the open spaces, each member having a shape corresponding to that of the corresponding open space and extending laterally, thereby maintaining a coupled structure of the interlocking pieces.

7. A bridge deck as claimed in claim 6, wherein the fixing wedge members are inserted into the inner spaces, the member having a shape corresponding to that of the inner spaces.

8. The fiber reinforced polymer composite deck module as claimed in claim 1, wherein the first, second, third and fourth interlocking pieces extend in a direction substantially parallel to a longitudinal direction of the deck module.

9. The fiber reinforced polymer composite deck module as claimed in claim 1, wherein the first, second, third and fourth interlocking pieces protrude downward and upward, respectively, in a direction substantially perpendicular to a longitudinal direction of the deck module.

10. The fiber reinforced polymer composite deck module as claimed in claim 1, wherein the web comprises at least a first web member, a second web member and a third web member disposed between the upper and lower plates within the deck module and the plurality of divisional portions of polygonal tubular cross-sectional shape are delimited by the first web member, the second web member and the third web member, the upper plate and the lower plate.

* * * * *